US007829516B2

(12) United States Patent
Smith et al.

(10) Patent No.: US 7,829,516 B2
(45) Date of Patent: Nov. 9, 2010

(54) WAREWASHING COMPOSITION COMPRISING A ZN/AL CORROSION INHIBITOR FOR USE IN AUTOMATIC DISHWASHING MACHINES

(75) Inventors: Kim R. Smith, Woodbury, MN (US); Keith E. Olson, Apple Valley, MN (US); Howie Kestell, Burnsville, MN (US); Michael J. Bartelme, Eden Prairie, MN (US); Steven E. Lentsch, St. Paul, MN (US); Victor F. Man, St. Paul, MN (US); Burton M. Baum, Laguna Woods, CA (US); Terence P. Everson, Eagan, MN (US)

(73) Assignee: Ecolab USA Inc., St. Paul, MN (US)

( * ) Notice: Subject to any disclaimer, the term of this patent is extended or adjusted under 35 U.S.C. 154(b) by 0 days.

(21) Appl. No.: 12/617,419

(22) Filed: Nov. 12, 2009

(65) Prior Publication Data

US 2010/0056414 A1 Mar. 4, 2010

Related U.S. Application Data

(60) Continuation of application No. 12/250,177, filed on Oct. 13, 2008, now Pat. No. 7,638,473, which is a division of application No. 11/499,994, filed on Aug. 7, 2006, now Pat. No. 7,452,853, which is a continuation of application No. 10/877,049, filed on Jun. 25, 2004, now Pat. No. 7,196,044, which is a continuation-in-part of application No. 10/612,474, filed on Jul. 2, 2003, now Pat. No. 7,135,448.

(51) Int. Cl.
*C11D 3/395* (2006.01)
*C11D 7/10* (2006.01)

(52) U.S. Cl. ..... 510/225; 510/220; 510/224; 510/227; 510/233; 510/367; 510/379; 510/439; 510/441; 510/445; 510/485; 510/508; 510/514; 510/521

(58) Field of Classification Search ..... 510/220, 510/224, 225, 227, 233, 367, 379, 439, 441, 510/445, 485, 508, 514, 521
See application file for complete search history.

(56) References Cited

U.S. PATENT DOCUMENTS

| | | | |
|---|---|---|---|
| 2,447,297 | A | 8/1948 | Wegst et al. |
| 2,514,304 | A | 7/1950 | Bacon et al. |
| 2,575,576 | A | 11/1951 | Bacon et al. |
| 3,048,548 | A | 8/1962 | Martin et al. |
| 3,128,250 | A | 4/1964 | Lintner |
| 3,255,117 | A | 6/1966 | Knapp et al. |
| 3,334,147 | A | 8/1967 | Brunelle et al. |
| 3,350,318 | A | 10/1967 | Green |
| 3,442,242 | A | 5/1969 | Laskey et al. |
| 3,677,820 | A | 7/1972 | Rutkowski |
| 3,701,736 | A | 10/1972 | Austin et al. |
| 3,755,180 | A | 8/1973 | Austin |
| 3,764,559 | A | 10/1973 | Mizuno et al. |
| 3,966,627 | A | 6/1976 | Gray |
| 4,102,799 | A | 7/1978 | Finck |
| 4,390,441 | A | 6/1983 | Beavan |
| 4,426,362 | A | 1/1984 | Copeland et al. |
| 4,443,270 | A | 4/1984 | Biard et al. |
| 4,501,681 | A | 2/1985 | Groult et al. |
| 4,606,775 | A | 8/1986 | Robinson et al. |
| 4,618,914 | A | 10/1986 | Sato et al. |
| 4,687,121 | A | 8/1987 | Copeland |
| 4,690,305 | A | 9/1987 | Copeland |
| RE32,763 | E | 10/1988 | Fernholtz et al. |
| RE32,818 | E | 1/1989 | Fernholz et al. |

(Continued)

FOREIGN PATENT DOCUMENTS

DE 25 39 531 A 3/1977

(Continued)

OTHER PUBLICATIONS

Altenschoepfer, T., "The Present Position of Investigations into the Behavior of Glass During Mechanical Washing," *The Effect of Detergents on Glassware . . . in Domestic Dishwashers*, papers presented in symposium presided by W.W. Fletcher from the B.G.I.R.A—Sheffield held in the "Institut National du Verre" in Charleroi, pp. 62-77 (Apr. 1971).

Mayaux, P., "Mechanism of Glass Attack by Chemical Agents," *The Effect of Detergents on Glassware . . . in Domestic Dishwashers*, papers presented in symposium presided by W.W. Fletcher from the B.G.I.R.A—Sheffield held in the "Institut National du Verre" in Charleroi, pp. 1-8 (Apr. 1971).

"Chelating Agents," *Kirk-Othmer Encyclopedia of Chemical Technology—Castor Oil to Chlorosulfuric Acid*, Third Edition, vol. 5, pp. 339-367 (© 1979).

"Emulsions," *Kirk-Othmer Encyclopedia of Chemical Technology—Diuretics to Emulsions*, Third Edition, vol. 8, pp. 900-912 (© 1979).

Jourbert, D. et al., "Etching of Glassware in Mechanical Dishwashing," *Soap & Chemical Specialties*, pp. 5, 62, 64, and 67-68 (Mar. 1971).

(Continued)

*Primary Examiner*—Charles I Boyer
(74) *Attorney, Agent, or Firm*—Andrew D. Sorensen; Laura C. DiLorenzo

(57) ABSTRACT

A warewashing detergent composition is provided according to the invention. The warewashing detergent composition includes a cleaning agent, an alkaline source, and a corrosion inhibitor. The cleaning agent comprises a detersive amount of a surfactant. The alkaline source is provided in an amount effective to provide a use composition having a pH of at least about 8. The corrosion inhibitor includes a source of aluminum ion and a source of zinc ion. The relative amounts of the source of zinc ion and the source of aluminum ion can be controlled to reduce visible filming when the warewashing detergent composition is used in the presence of hard water. Methods for using and manufacturing a warewashing detergent composition are provided.

17 Claims, 6 Drawing Sheets

U.S. PATENT DOCUMENTS

| | | | |
|---|---|---|---|
| 4,826,661 | A | 5/1989 | Copeland et al. |
| 4,830,773 | A | 5/1989 | Olson |
| 4,908,148 | A | 3/1990 | Caravajal et al. |
| 4,917,812 | A | 4/1990 | Cilley |
| 4,933,101 | A | 6/1990 | Cilley et al. |
| 4,954,280 | A | 9/1990 | Elliott et al. |
| 5,152,910 | A | 10/1992 | Savio et al. |
| 5,152,911 | A | 10/1992 | Savio et al. |
| 5,169,552 | A | 12/1992 | Wise |
| 5,281,352 | A | 1/1994 | Savio et al. |
| 5,292,446 | A | 3/1994 | Painter et al. |
| 5,384,061 | A | 1/1995 | Wise |
| 5,512,266 | A | 4/1996 | Brown et al. |
| 5,624,892 | A | 4/1997 | Angevaare et al. |
| 5,625,842 | A | 4/1997 | Dalrymple |
| 5,698,506 | A | 12/1997 | Angevaare et al. |
| 5,700,294 | A | 12/1997 | Boittiaux et al. |
| 5,721,277 | A | 2/1998 | Tang |
| 5,731,276 | A | 3/1998 | Argo et al. |
| 5,731,277 | A | 3/1998 | Gary et al. |
| 6,037,319 | A | 3/2000 | Dickler et al. |
| 6,150,324 | A | 11/2000 | Lentsch et al. |
| 6,156,715 | A | 12/2000 | Lentsch et al. |
| 6,164,296 | A | 12/2000 | Lentsch et al. |
| 6,177,392 | B1 | 1/2001 | Lentsch et al. |
| 6,228,825 | B1 | 5/2001 | Gorlin et al. |
| 6,258,765 | B1 | 7/2001 | Wei et al. |
| 6,303,553 | B1 | 10/2001 | Gorlin |
| 6,369,021 | B1 | 4/2002 | Man et al. |
| 6,410,495 | B1 | 6/2002 | Lentsch et al. |
| 6,448,210 | B1 | 9/2002 | Keyes et al. |
| 6,448,212 | B1 | 9/2002 | Holderbaum et al. |
| 6,475,977 | B1 | 11/2002 | Pfeiffer et al. |
| 6,605,578 | B1 | 8/2003 | Fleckenstein et al. |
| 6,622,736 | B1 | 9/2003 | Hahn |
| 6,632,785 | B2 | 10/2003 | Pfeiffer et al. |
| 6,670,314 | B2 | 12/2003 | Smith et al. |
| 6,727,215 | B2 | 4/2004 | Roberts et al. |
| 2003/0050205 | A1 | 3/2003 | Hahn |
| 2003/0180466 | A1 | 9/2003 | Rohrbaugh et al. |

FOREIGN PATENT DOCUMENTS

| | | | |
|---|---|---|---|
| EP | 0 070 587 | A1 | 1/1983 |
| EP | 0 387 997 | A2 | 9/1990 |
| EP | 0 962 521 | A | 12/1999 |
| GB | 1 442 885 | A | 7/1976 |
| GB | 1 517 029 | | 7/1978 |
| GB | 2 364 324 | | 1/2002 |
| GB | 2 372 500 | A | 8/2002 |
| WO | WO 96/36687 | | 11/1996 |
| WO | WO 00/56851 | | 9/2000 |
| WO | WO 02/068352 | A2 | 9/2002 |
| WO | WO 2004/061067 | A2 | 7/2004 |
| WO | WO 2004/061068 | A1 | 7/2004 |
| WO | WO 2004/061069 | A1 | 7/2004 |
| WO | WO 2004/061070 | A1 | 7/2004 |
| WO | WO 2005/005589 | A1 | 1/2005 |
| WO | WO 2005/033724 | A1 | 4/2005 |

OTHER PUBLICATIONS

"Table 4. Extraction Solvents and Reagents" and "Selected Sorbents," *Kirk-Othmer Encyclopedia of Chemical Technology*, Third Edition, vol. 23, pp. 319-320 (© 1979).

Mizuno, William G., "Dishwashing," *Surfactant Science Series, Detergency Theory and Test Methods*, Marcel Dekker Press, pp. 815-884 (© 1981).

X1 = A: Na aluminate
X2 = B: Ca chloride
X3 = C: Zn chloride

X1 = A: Na aluminate
X2 = B: Ca chloride
X3 = C: Zn chloride

WAREWASHING COMPOSITION COMPRISING A ZN/AL CORROSION INHIBITOR FOR USE IN AUTOMATIC DISHWASHING MACHINES

CROSS REFERENCE TO RELATED APPLICATIONS

This is a continuation application of U.S. application Ser. No. 12/250,177, filed with the United States Patent and Trademark Office on Oct. 13, 2008, published as US 2009-0038649 and is now allowed which is a divisional application of U.S. application Ser. No. 11/499,994 that was filed with the United States Patent and Trademark Office on Aug. 7, 2006 and is now issued U.S. Pat. No. 7,452,853. U.S. Pat. No. 7,452,853 is a continuation of U.S. application Ser. No. 10/877,049 that was filed with the United States Patent and Trademark Office on Jun. 25, 2004, and is now issued U.S. Pat. No. 7,196,044. U.S. Pat. No. 7,196,044 is a continuation-in-part of U.S. application Ser. No. 10/612,474 that was filed with the United States Patent and Trademark Office on Jul. 2, 2003 and is now issued U.S. Pat. No. 7,135,448. The entire disclosures of which are hereby expressly incorporated herein by reference including, without limitation, the specification, claims, and abstracts, as well as any figures, tables, or drawings thereof.

FIELD OF THE INVENTION

The invention relates to warewashing compositions for use in automatic dishwashing machines, methods for manufacturing warewashing compositions for use in automatic dishwashing machines, and methods for using warewashing compositions in automatic dishwashing machines. The automatic dishwashing machines can be commercial and/or domestic dishwashing machines. The warewashing composition includes a corrosion inhibitor to reduce corrosion of glass. The warewashing composition can be provided for use in hard water environments.

BACKGROUND OF THE INVENTION

Glassware that is repetitively washed in automatic dishwashing machines has a tendency to develop a surface cloudiness that is irreversible. The cloudiness often manifests itself as an iridescent film that displays rainbow hues in light reflected from the glass surface. The glass becomes progressively more opaque with repeated washings. This cloudiness is believed to be a type of etching or corrosion of the glass. This same type of corrosion is seen on other articles including china, porcelain, and ceramics.

Corrosion of glass in automatic dishwashers is a well known phenomenon. A paper by D. Joubert and H. Van Daele entitled "Etching of Glassware in Mechanical Dishwashing" in Soap and Chemical Specialties, March, 1971, pp. 62, 64, and 67, discusses the influence of various detergent components, particularly those of an alkaline nature. This subject is also discussed in a paper entitled "The Present Position of Investigations into the Behavior of Glass During Mechanical Dishwashing" presented by Th. Altenschoepfer in April, 1971, at a symposium in Charleroi, Belgium, on "The Effect of Detergents on Glassware in Domestic Dishwashers." See, also, another paper delivered at the same symposium by P. Mayaux entitled "Mechanism of Glass Attack by Chemical Agents."

It is believed that the glassware corrosion problem relates to two separate phenomena; the first is corrosion or etching due to the leaching out of minerals from the glass composition itself together with hydrolysis of the silicate network, and the second is deposition and redeposition of silicate material onto the glass. It is a combination of the two that can result in the cloudy appearance of glassware that has been washed repeatedly in automatic dishwashers. This cloudiness often manifests itself in the early stages as an iridescent film that becomes progressively more opaque with repeated washings.

Corrosion inhibitors have been added to automatic dishwashing compositions to reduce the etching or corrosion found on glass. For example, see U.S. Pat. No. 2,447,297 to Wegst et al.; U.S. Pat. No. 2,514,304 to Bacon et al.; U.S. Pat. No. 4,443,270 to Baird et al.; U.S. Pat. No. 4,933,101 to Cilley et al.; U.S. Pat. No. 4,908,148 to Caravajal et al.; U.S. Pat. No. 4,390,441 to Beavan. Zinc has been disclosed for use in preventing glass corrosion. For example, see U.S. Pat. No. 4,917,812 to Cilley; U.S. Pat. No. 3,677,820 to Rutkowski; U.S. Pat. No. 3,255,117 to Knapp; U.S. Pat. No. 3,350,318 to Green; U.S. Pat. No. 2,575,576 to Bacon et al.; U.S. Pat. No. 3,755,180 to Austin; and U.S. Pat. No. 3,966,627 to Gray. Automatic dishwashing detergent compositions incorporating aluminum salts have been disclosed for reducing glass corrosion. See International Publication No. WO 96/36687; U.S. Pat. No. 3,701,736 to Austin et al.; U.S. Pat. No. 5,624,892 to Angevaare et al.; and U.S. Pat. No. 5,624,892 to Angevaare et al.; and U.S. Pat. No. 5,598,506 to Angevaare et al.

SUMMARY OF THE INVENTION

A warewashing detergent composition is provided according to the invention. The warewashing detergent composition can include a cleaning agent, an alkaline source, and a corrosion inhibitor. The cleaning agent can include a detersive amount of a surfactant. The alkaline source can be provided in an amount effective to provide a use composition having a pH of at least about 8. The corrosion inhibitor includes a source of aluminum ion and a source of zinc ion. The corrosion inhibitor is provided in an amount sufficient to reduce corrosion of glass when the warewashing detergent composition is provided as a use composition for washing glass in an automatic dishwashing machine. The amounts of the source of zinc ion and the source of aluminum ion can be controlled to provide, in the use composition, a weight ratio of the zinc ion to the aluminum ion sufficient to reduce corrosion on glass washed with the use composition.

Corrosion of glass can be characterized by the appearance of an iridescent film that displays rainbow hues of light reflected from the glass surface that progressively becomes more cloudy with additional washing. One type of corrosion that is believed to exist manifests itself as a film on the glass surface formed from precipitates. It is believed that this type of corrosion is a particular problem in the presence of hard water where free calcium ions are available for precipitation. In order to reduce this type of corrosion, the amounts of the source of zinc ion and the source of aluminum ion can be controlled. For example, the amounts of the source of zinc ion and the source of aluminum ion can be controlled to provide a weight ratio of the zinc ion to the aluminum ion in the use composition of at least about 2:1. An exemplary range of the source of zinc ion to the source of aluminum ion can be between about 20:1 and about 3:1. The amount of the corrosion inhibitor can be provided so that the use composition provides a desired level of etch resistance. An exemplary amount of the corrosion inhibitor that can be provided in the use composition can be between about 6 ppm and about 300 ppm. Furthermore, the amount of the corrosion inhibitor that can be provided in the concentrate can be between about 0.5 wt. % and about 25 wt. %.

A warewashing detergent composition can be provided according to the invention that does not include an alkaline source. That is, the warewashing detergent composition can provide a use composition that has a pH above or below 8. In addition, a cleaning composition is provided according to the invention that can be used in environments other than inside a dishwashing machine.

A method for using a warewashing detergent composition is provided according to the invention. The method can include steps of diluting a warewashing detergent composition with water at a dilution ratio of water to warewashing detergent composition of at least about 20:1, and washing ware with the use composition in an automatic dishwashing machine.

A method for using a detergent composition is provided according to the invention. The method can include steps of diluting a detergent composition with water at a dilution ratio of water to detergent composition of at least about 20:1 and washing a hard surface with the use composition. Exemplary hard surfaces that can be washed include glass and ceramic. Exemplary glass surfaces include windows and mirrors.

A method for manufacturing a warewashing detergent composition is provided according to the invention. The method can include a step of adding a corrosion inhibitor to a warewashing detergent composition. The corrosion inhibitor can be added to the warewashing detergent composition when the warewashing detergent composition is a concentrate and/or when the warewashing detergent composition is a use composition.

DETAILED DESCRIPTION OF THE INVENTION

Figure 1:
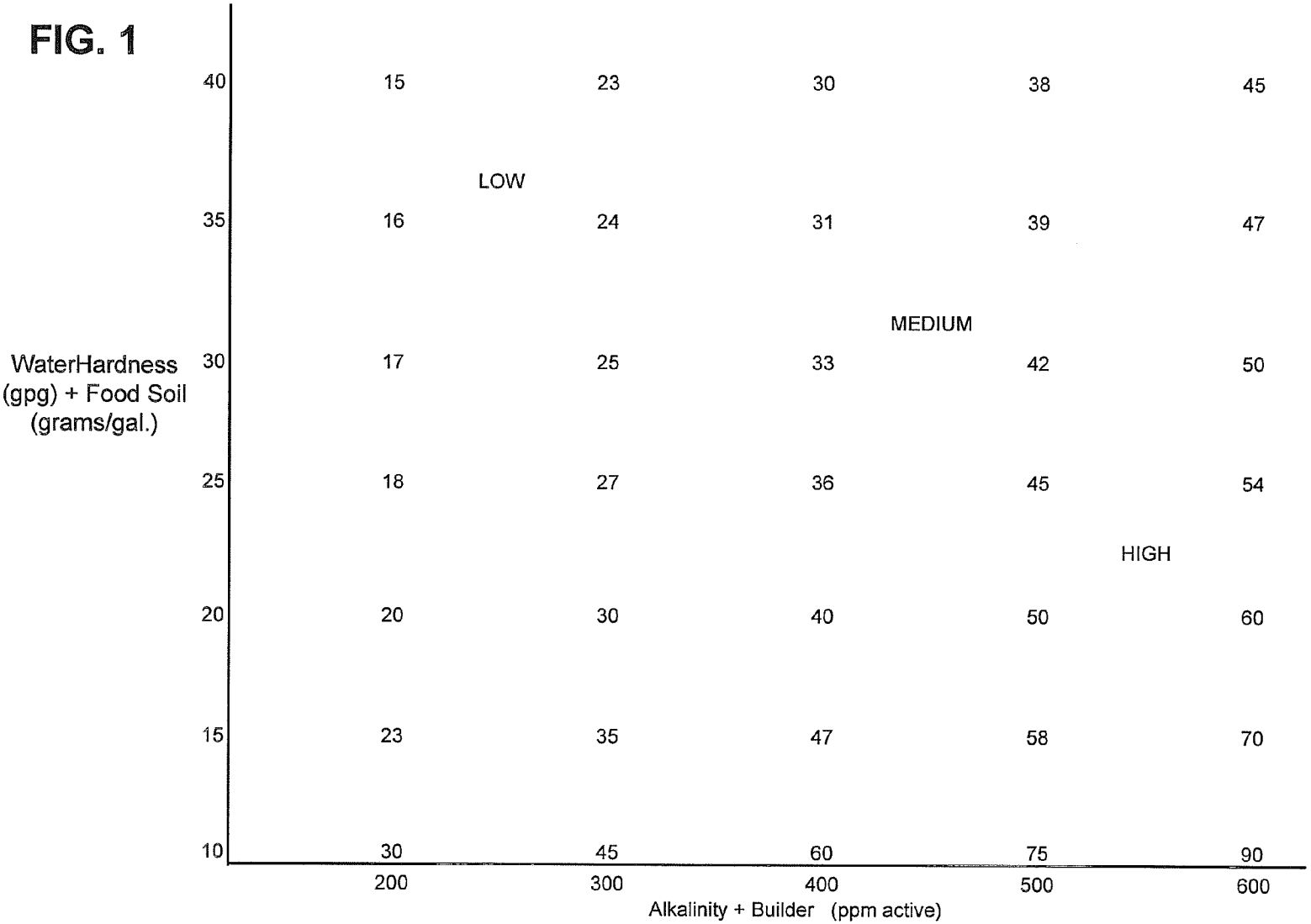
FIG. 1 is a graph displaying a guide for selecting corrosion inhibitor concentration in a use composition as a function of water hardness, food soil, alkalinity, and builder levels.

The invention provides a warewashing composition for protecting articles such as glassware from corrosion in an automatic dishwashing or warewashing machine during automatic dishwashing or warewashing. Glassware corrosion can be detected as a cloudiness on the glass surface. The cloudiness may manifest itself in the early stages as an iridescent film that displays rainbow hues in light reflected from the glass surface, and that progressively becomes more cloudy. Glass corrosion generally refers to a deterioration of the glass resulting from an etching of the glass due to the leaching out of minerals from the glass together with hydrolysis of the silicate network, and/or filming resulting from deposition and redeposition of silicate material onto the glass. It is believed that an additional type of filming can result from deposition of calcium salts onto glass. Calcium may have a tendency to interact with certain metals such as aluminum and precipitate forming a film on the glass.

U.S. application Ser. No. 10/612,474 that was filed with the United States Patent and Trademark Office on Jul. 2, 2003 is directed at warewashing compositions for use in automatic dishwashing machines and to methods for manufacturing and using a warewashing composition. The present invention is at least in part directed at providing a warewashing composition that provides improved resistance to corrosion of glass in the presence of hard water. The entire disclosure of U.S. application Ser. No. 10/612,474 is incorporated herein by reference.

The warewashing composition can be referred to as a cleaning composition and can be available for cleaning in environments other than inside an automatic dishwashing or warewashing machine. It should be understood that the term "warewashing" refers to and is meant to include both warewashing and dishwashing. Furthermore, the warewashing composition can refer to a concentrate and to a use composition. In general, a concentrate is the composition that is intended to be diluted with water to provide the use composition that contacts the glass surface to provide the desired effect, such as, cleaning.

The warewashing composition includes a corrosion inhibitor that contains an effective amount of a source of aluminum ion and an effective amount of a source of zinc ion to provide a use composition exhibiting resistance to glass corrosion. The effective amount of a source of aluminum ion and the effective amount of a source of zinc ion can be characterized as amounts sufficient to provide a use composition exhibiting reduced glass corrosion compared with a composition that is identical except that it contains only one of the source of aluminum ion and the source of zinc ion at a concentration equal to the combination of the source of aluminum ion and the source of zinc ion. It is expected that combining the source of aluminum ion and the source of zinc ion provides a use composition exhibiting improved glass corrosion resistance compared with an otherwise identical use composition except prepared from a concentrate containing only one of the source of aluminum ion and the source of zinc ion at a concentration equivalent to the concentration of the combined amounts. The combination of the source of aluminum ion and the source of zinc ion can be characterized as a synergistic combination when the improvement in corrosion resistance is greater than the expected cumulative effect of the source of aluminum ion and the source of zinc ion.

The warewashing composition that contacts the articles to be washed in an automatic dishwashing process can be referred to as the use composition. The use composition can be provided at a solids concentration that provides a desired level of detersive properties. The solids concentration refers to the concentration of the non-water components in the use composition. The warewashing composition prior to dilution to provide the use composition can be referred to as the warewashing composition concentrate or more simply as the concentrate. The concentrate can be provided in various forms including as a liquid and as a solid. It should be understood that pastes and gels can be considered a type of liquid. In addition, it should be understood that powders, agglomerates, pellets, tablets, and blocks are types of a solid.

It is expected that the warewashing composition will be used by diluting the concentrate with water at the situs or location of use to provide the use composition. In many cases when using the warewashing composition in an automatic dishwashing or warewashing machine, it is expected that that situs or location of use will be inside the automatic dishwashing or warewashing machine. When the warewashing composition is used in a residential or home-style dishwashing machine, it is expected that the composition may be placed in the detergent compartment of the dishwashing machine. Often the detergent compartment is located in the door of the dishwashing machine. The warewashing composition can be provided in the form that allows for introduction of a single dose of the warewashing composition into the compartment. In general, single dose refers to the amount of the warewashing composition that is desired for a single warewashing application. In many commercial dishwashing or warewashing machines, and even for certain residential or home-style dishwashing machines, it is expected that a large quantity of warewashing composition can be provided in a compartment that allows for the release of a single dose amount of the composition for each warewashing or dishwashing cycle. Such a compartment may be provided as part of the warewashing or dishwashing machine or it may be provided as a separate structure connected to the warewashing or dishwashing machine by a hose for delivery of liquid thereto. For example, a block of the warewashing composition can be provided in a hopper, and water can be sprayed against the surface of the block to provide a liquid concentrate that can be introduced into the dishwashing machine. The hopper can be a part of the dishwashing machine or it can be provided separate from the dishwashing machine.

It is expected that the water of dilution that is used to dilute the concentrate to form the use composition may vary from one location to another. That is, it is expected that water available at one location may have a relatively low level of total dissolved solids while water at another location may be considered "hard." In general, hard water is considered to be water having a total dissolved solids (TDS) content in excess of 200 ppm. The hardness of the water can effect glass corrosion. In general, water having a higher total dissolved solids content has a tendency to corrode glass quicker than water having a low level of total dissolved solids. The hardness of the water can be addressed in a number of ways. For example, the water can be softened. That is, the calcium and the magnesium can be replaced with sodium. In addition, the warewashing composition can include builders and/or chelating agents at levels sufficient to handle the hardness. Water softeners have a tendency to break down on occasion and/or run out of material that provides the softening effect. In addition, certain environments may provide water having a hardness that exceeds the builder or chelating capacity of the warewashing detergent composition. In such circumstances, it is believed that there may be available free calcium ion that may contribute to glass corrosion. The warewashing composition can be provided with a corrosion inhibitor that resists glass corrosion even under these conditions.

The use composition can have a solids content that is sufficient to provide the desired level of cleaning while avoiding wasting the warewashing composition by using too much. In general, it is expected that the use composition will have a solids content of at least about 0.05 wt. %, and can have a solids content of between about 0.05 wt. % and about 0.75 wt. %. The use composition can be prepared from the concentrate by diluting with water at a dilution ratio that provides convenient use of the concentrate and provides the formation of a use composition having desired detersive properties. It is expected that the concentrate can be diluted at a ratio of water to concentrate of at least about 20:1, and can be at between about 20:1 and about 200:1, to provide a use composition having desired detersive properties.

The warewashing composition can be provided in the form of a solid. Exemplary solid dishwashing compositions are disclosed in U.S. Pat. No. 6,410,495 to Lentsch et al., U.S. Pat. No. 6,369,021 to Man et al., U.S. Pat. No. 6,258,765 to Wei et al, U.S. Pat. No. 6,177,392 to Lentsch et al., U.S. Pat. No. 6,164,296 to Lentsch et al., U.S. Pat. No. 6,156,715 to Lentsch et al., and U.S. Pat. No. 6,150,624 to Lentsch et al. The compositions of each of these patents are incorporated herein by reference. The compositions of each of these patents can be modified to provide a warewashing composition that includes an effective amount of a corrosion inhibitor to provide a desired reduction of etching and filming of glass.

Corrosion Inhibitor

The corrosion inhibitor is included in the warewashing composition in an amount sufficient to provide a use composition that exhibits a rate of corrosion of glass that is less than the rate of corrosion of glass for an otherwise identical use composition except for the absence of the corrosion inhibitor. The corrosion inhibitor refers to the combination of a source of aluminum ion and a source of zinc ion. The source of aluminum ion and the source of zinc ion provide aluminum ion and zinc ion, respectively, when the warewashing composition is provided in the form of a use composition. It is not entirely clear what exact ions are present in the use composition. For example, when the use composition is alkaline, it is expected that the aluminum ion may be available as an aluminate ion. Accordingly, it should be understood that the terms "aluminum ion" and "zinc ion" refer to ions that contain metals aluminum and zinc, respectively. The terms "aluminum ion" and "zinc ion" are not limited to elemental aluminum provided as an ion and elemental zinc provided as an ion, respectively.

Any component that provides an aluminum ion in a use composition can be referred to as a source of aluminum ion, and any component that provides a zinc ion when provided in a use composition can be referred to as a source of zinc ion. It is not necessary for the source of aluminum ion and/or the source of zinc ion to react to form the aluminum ion and/or the zinc ion. It should be understood that aluminum ion can be considered a source of aluminum ion, and zinc ion can be considered a source of zinc ion. The source of aluminum ion and the source of zinc ion can be provided as organic salts, inorganic salts, and mixtures thereof. Exemplary sources of aluminum ion include aluminum salts such as sodium aluminate, aluminum bromide, aluminum chlorate, aluminum chloride, aluminum iodide, aluminum nitrate, aluminum sulfate, aluminum acetate, aluminum formate, aluminum tartrate, aluminum lactate, aluminum oleate, aluminum bromate, aluminum borate, aluminum potassium sulfate, aluminum zinc sulfate, aluminum oxide, aluminum phosphate, and mixtures thereof. Exemplary sources of zinc ion include zinc salts such as zinc chloride, zinc sulfate, zinc nitrate, zinc iodide, zinc thiocyanate, zinc fluorosilicate, zinc dichromate, zinc chlorate, sodium zincate, zinc gluconate, zinc acetate, zinc benzoate, zinc citrate, zinc lactate, zinc formate, zinc bromate, zinc bromide, zinc fluoride, zinc fluosilicate, zinc salicylate, zinc oxide, zinc carbonate, and mixtures thereof. In addition, the source of aluminum ion and the source of zinc ion can be selected as those components that are characterized by the United States Food and Drug Administration as direct or indirect food additives. Because the warewashing detergent composition will be used to wash articles that contact food, it may be desirable to select the source of aluminum ion and the source of zinc ion as components that are characterized by the United States Food and Drug Administration as direct or indirect food additives. By way of theory, it is believed that the source of aluminum ion and the source of zinc ion provide aluminum ion and zinc ion, respectively, that interact and precipitate onto the surfaces of articles that are being washed. In addition, it is believed that the precipitate may remain with the article until it is subsequently removed in a subsequent dishwashing operation.

The source of aluminum ion and the source of zinc ion can be provided in forms that assist in solubilizing the source of aluminum ion and the source of zinc ion to form the aluminum ion and the zinc ion when provided in a use composition. The size of the source of aluminum ion and the source of zinc ion can be adjusted to enhance solubility. For example, the source of aluminum ion and the source of zinc ion can be provided as nanoparticles to help increase the rate of solubility. The source of aluminum ion and the source of zinc ion can be provided as particles having a size of less than about 500 nm.

It is expected that the aluminum ion and the zinc ion will interact in the use composition and precipitate onto the glass surface. In an alkaline environment, it is expected that aluminate ion will interact with zinc ion to form zinc aluminate, and that the zinc aluminate will precipitate. Although zinc aluminate is considered insoluble in water, it does not precipitate too quickly. As a result, it is expected that not all of the zinc aluminate precipitates during a wash cycle and much of the zinc aluminate remains in the use composition and is removed from the dishwasher as the use composition drains. As a result, the film that forms on the glass surface by the zinc aluminate precipitate can be substantially invisible to the human eye. It should be understood that the phrase "substantially invisible to the human eye" refers to the lack of visible filming by the zinc aluminate. Visible filming refers to a cloudy appearance that may begin with an iridescent film that displays rainbow hues in light reflected from the glass. By controlling the precipitation of the aluminum ion and the zinc ion, it is expected that the amount of precipitate that forms on the glass can be controlled to provide a film on the glass that is both substantially invisible to the human eye and that functions as a protective layer. By functioning as a protective layer, it is expected that the film formed by precipitation of aluminum ion and the zinc ion will provide resistance to corrosion of the glass surface. That is, other components of the use composition such as alkalinity and builders or sequestrants may attack the protective layer before attacking the glass surface. It is believed that the protective layer can function as a sacrificial layer wherein the alkalinity, builders, or sequestrants attack the protective layer and remove portions of the protective layer, and that controlled precipitation of the aluminum ion and the zinc ion regenerates the protective layer.

Washing glass in the presence of hard water can be problematic because the calcium in the water has a tendency to interact with the corrosion inhibitor and precipitate onto the glass surface fairly rapidly resulting in a visible film. The existence of a visible film can be referred to as "filming" and is considered a type of corrosion because it is substantially irreversible. It should be understood that the phrase "substantially irreversible" refers to the inability of the film to disappear as a result of conventional washing. It is believed that a portion of the film may be removed as a result of careful treatment with certain types of chemicals in a laboratory. In a dishwashing machine, such treatment to remove the visible filming would be impractical. The calcium in hard water has a tendency to interact with the aluminum ion and precipitate onto the glass. In the case of aluminate ion, it is believed that calcium reacts with aluminate ion to form calcium aluminate that precipitates relatively quickly.

Hard water is often characterized as water containing a total dissolved solids (TDS) content in excess of 200 ppm. This type of water is often referred to as high solids containing water. In certain localities, the water contains a total dissolved solids content in excess of 400 ppm, and even in excess of 800 ppm. The dissolved solids refers to the presence of calcium and magnesium. These components of hard water can be addressed by softening the water and/or by using builders and sequestrants in the warewashing composition. In the case of water softening, sodium is often used to displace the calcium and magnesium. The warewashing composition can include builder and/or sequestrant to handle the calcium and thereby reduce its tendency to precipitate with the aluminum ion. The calcium that is available in a use composition for precipitating with the aluminum ion can be referred to as "free calcium ion" and is generally considered to be the unchelated calcium ion in the use composition. When the level of free calcium ion is relatively small, it is believed that the weight ratio of the zinc ion to the aluminum ion can be provided at levels that provides the desired corrosion resistances exhibited by a lack of etching. Because the presence of free calcium ion is not a particular concern, it is believed that filming caused by precipitation of calcium ion and aluminum ion will not be very significant. As a result, the ratio of the zinc ion to the aluminum ion can be selected as described in U.S. application Ser. No. 10/612,474 that was filed with the United States Patent and Trademark Office on Jul. 2, 2003, and which is incorporated herein by reference in its entirety. By way of example, the weight ratio of the zinc ion to the aluminum ion can be provided in a range of between about 20:1 to about 1:6, and the weight ratio of the zinc ion to the aluminum ion can be provided in a range of between about 15:1 and about 1:2. In situations where the free calcium ion is available in the use composition at a level sufficient to cause precipitation of the calcium ion and the aluminum ion to provide visible filming, the ratio of the zinc ion to the aluminum ion can be controlled to provide resistance to etching and also resistance to visible filming from precipitation of the calcium ion and the aluminum ion. For example, when the use composition contains in excess of 200 ppm free calcium ion, the weight ratio of the zinc ion to the aluminum ion can be provided at greater than 2:1. By way of an exemplary range, it is believed that the weight ratio of the zinc ion to the aluminum ion can be provided at between about 20:1 and about 2:1. Furthermore, the weight ratio of zinc ion to aluminum ion can be greater than about 3:1, and can be provided in a range of between about 15:1 and about 3:1. In addition, the weight ratio of zinc ion to aluminum ion can be provided at greater than about 4:1 and can be provided at greater than about 6:1. It should be understood that the ratio of zinc ion to aluminum ion may exceed 15:1 and 20:1 when corrosion resistance can still be provided. Furthermore, it should be understood that the reference to the weight ratio of the zinc ion and the aluminum ion refers to a weight ratio based upon the zinc component of the zinc ion and the aluminum component of the aluminum ion. That is, it is the weight of the metal that is determined for purposes of the weight ratio rather than the weight of the entire molecule that may contain the metal. For example, in the case of sodium aluminate, the weight of the aluminum ion refers to the aluminum component of the molecule rather than the entire aluminate ion.

The corrosion inhibitor can be provided in the use composition in an amount effective to reduce corrosion of glass. It is expected that the use composition will include at least about 6 ppm of the corrosion inhibitor to provide desired corrosion inhibition properties. The amount of the corrosion inhibitor is calculated based upon the combined amount of the source of aluminum ion and the source of zinc ion. It is expected that larger amounts of corrosion inhibitor can be used in the use composition without deleterious effects. It is expected that at a certain point, the additive effect of increased corrosion resistance with increasing corrosion inhibitor concentration will be lost, and additional corrosion inhibitor will simply increase the cost of using the cleaning composition. In the case of a use composition containing in excess of 200 ppm free calcium ion, it is expected that providing a higher concentration of aluminum ion may increase the availability of the calcium ion to precipitate with the aluminum ion. Accordingly, the upper limit of the concentration of the corrosion inhibitor can be selected to avoid visible filming. The use composition can include between about 6 ppm and about 300 ppm of the corrosion inhibitor, and between about 20 ppm and about 200 ppm of the corrosion inhibitor. In the case of the concentrate that is intended to be diluted to a use composition, it is expected that the corrosion inhibitor will be provided at a concentration of between about 0.5 wt. % and about 25 wt. %, between about 0.5 wt. % and about 15 wt. %, between about 1 wt. % and about 10 wt. %, and between about 2 wt. % and about 5 wt. %.

Alkaline Sources

The warewashing composition according to the invention may include an effective amount of one or more alkaline sources to enhance cleaning of a substrate and improve soil removal performance of the composition. In general, an effective amount of one or more alkaline sources should be considered as an amount that provides a use composition having a pH of at least about 8. When the use composition has a pH of between about 8 and about 10, it can be considered mildly alkaline, and when the pH is greater than about 12, the use composition can be considered caustic. In general, it is desirable to provide the use composition as a mildly alkaline cleaning composition because it is considered to be more safe than the caustic based use compositions.

The warewashing composition can include a metal carbonate and/or an alkali metal hydroxide. Exemplary metal carbonates that can be used include, for example, sodium or potassium carbonate, bicarbonate, sesquicarbonate, mixtures thereof. Exemplary alkali metal hydroxides that can be used include, for example, sodium or potassium hydroxide. An alkali metal hydroxide may be added to the composition in the form of solid beads, dissolved in an aqueous solution, or a combination thereof. Alkali metal hydroxides are commercially available as a solid in the form of prilled solids or beads having a mix of particle sizes ranging from about 12-100 U.S. mesh, or as an aqueous solution, as for example, as a 50 wt. % and a 73 wt. % solution.

The warewashing composition can include a sufficient amount of the alkaline source to provide the use composition with a pH of at least about 8. In general, it is expected that the concentrate will include the alkaline source in an amount of at least about 5 wt. %, at least about 10 wt. %, or at least about 15 wt. %. In order to provide sufficient room for other components in the concentrate, the alkaline source can be provided in the concentrate in an amount of less than about 60 wt. %. In addition, the alkaline source can be provided at a level of less than about 30 wt. % and less than about 20 wt. %. It is expected that the warewashing composition may provide a use composition that is useful at pH levels below about 8. In such compositions, an alkaline source may be omitted, and additional pH adjusting agents may be used to provide the use composition with the desired pH. Accordingly, it should be understood that the source of alkalinity can be characterized as an optional component.

Cleaning Agent

The warewashing composition can include at least one cleaning agent comprising a surfactant or surfactant system. A variety of surfactants can be used in a warewashing composition, such as anionic, nonionic, cationic, and zwitterionic surfactants. It should be understood that surfactants are an optional component of the warewashing composition and can be excluded from the concentrate. The warewashing composition, when provided as a concentrate, can include the cleaning agent in a range of between about 0.5 wt. % and about 20 wt. %, between about 0.5 wt. % and about 15 wt. %, between about 1.5 wt. % and about 15 wt. %, between about 1 wt. % and about 10 wt. %, and between about 2 wt. % and about 5 wt. %. Additional exemplary ranges of surfactant in a concentrate include about 0.5 wt. % to about 5 wt. %, and about 1 wt. % to about 3 wt. %.

Exemplary surfactants that can be used are commercially available from a number of sources. For a discussion of surfactants, see Kirk-Othmer, Encyclopedia of Chemical Technology, Third Edition, volume 8, pages 900-912. When the warewashing composition includes a cleaning agent, the cleaning agent can be provided in an amount effective to provide a desired level of cleaning.

Anionic surfactants useful in the warewashing composition includes, for example, carboxylates such as alkylcarboxylates (carboxylic acid salts) and polyalkoxycarboxylates, alcohol ethoxylate carboxylates, nonylphenol ethoxylate carboxylates, and the like; sulfonates such as alkylsulfonates, alkylbenzenesulfonates, alkylarylsulfonates, sulfonated fatty acid esters, and the like; sulfates such as sulfated alcohols, sulfated alcohol ethoxylates, sulfated alkylphenols, alkylsulfates, sulfosuccinates, alkylether sulfates, and the like; and phosphate esters such as alkylphosphate esters, and the like. Exemplary anionic surfactants include sodium alkylarylsulfonate, alpha-olefinsulfonate, and fatty alcohol sulfates.

Nonionic surfactants useful in the warewashing composition include, for example, those having a polyalkylene oxide polymer as a portion of the surfactant molecule. Such nonionic surfactants include, for example, chlorine-, benzyl-, methyl-, ethyl-, propyl-, butyl- and other like alkyl-capped polyethylene glycol ethers of fatty alcohols; polyalkylene oxide free nonionics such as alkyl polyglycosides; sorbitan and sucrose esters and their ethoxylates; alkoxylated ethylene diamine; alcohol alkoxylates such as alcohol ethoxylate propoxylates, alcohol propoxylates, alcohol propoxylate ethoxylate propoxylates, alcohol ethoxylate butoxylates, and the like; nonylphenol ethoxylate, polyoxyethylene glycol ethers and the like; carboxylic acid esters such as glycerol esters, polyoxyethylene esters, ethoxylated and glycol esters of fatty acids, and the like; carboxylic amides such as diethanolamine condensates, monoalkanolamine condensates, polyoxyethylene fatty acid amides, and the like; and polyalkylene oxide block copolymers including an ethylene oxide/propylene oxide block copolymer such as those commercially available under the trademark PLURONIC® (BASF-Wyandotte), and the like; and other like nonionic compounds. Silicone surfactants such as the ABIL® B8852 can also be used.

Cationic surfactants that can be used in the warewashing composition include amines such as primary, secondary and tertiary monoamines with $C_{18}$ alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imidazoline, and the like; and quaternary ammonium salts, as for example, alkylquaternary ammonium chloride surfactants such as n-alkyl($C_{12}$-$C_{18}$) dimethylbenzyl ammonium chloride, n-tetradecyldimethylbenzylammonium chloride monohydrate, a naphthylene-substituted quaternary ammonium chloride such as dimethyl-1-naphthylmethylammonium chloride, and the like. The cationic surfactant can be used to provide sanitizing properties.

Zwitterionic surfactants that can be used in the warewashing composition include betaines, imidazolines, and propinates. Because the warewashing composition is intended to be used in an automatic dishwashing or warewashing machine, the surfactants selected, if any surfactant is used, can be those that provide an acceptable level of foaming when used inside a dishwashing or warewashing machine. It should be understood that warewashing compositions for use in automatic dishwashing or warewashing machines are generally considered to be low-foaming compositions.

The surfactant can be selected to provide low foaming properties. One would understand that low foaming surfactants that provide the desired level of detersive activity are advantageous in an environment such as a dishwashing machine where the presence of large amounts of foaming can be problematic. In addition to selecting low foaming surfactants, one would understand that defoaming agents can be utilized to reduce the generation of foam. Accordingly, surfactants that are considered low foaming surfactants as well as other surfactants can be used in the warewashing composition and the level of foaming can be controlled by the addition of a defoaming agent.

Other Additives

The warewashing composition can include other additives, including conventional additives such as chelating/sequestering agents, bleaching agents, detergent builders or fillers, hardening agents or solubility modifiers, defoamers, anti-redeposition agents, threshold agents, stabilizers, dispersants, enzymes, aesthetic enhancing agents (i.e., dye, perfume), and the like. Adjuvants and other additive ingredients will vary according to the type of composition being manufactured. It should be understood that these additives are optional and need not be included in the cleaning composition. When they are included, they can be included in an amount that provides for the effectiveness of the particular type of component.

The warewashing composition can include chelating/sequestering agents such as an aminocarboxylic acid, a condensed phosphate, a phosphonate, a polyacrylate, and the like. In general, a chelating agent is a molecule capable of coordinating (i.e., binding) the metal ions commonly found in natural water to prevent the metal ions from interfering with the action of the other detersive ingredients of a cleaning composition. In general, chelating/sequestering agents can generally be referred to as a type of builder. The chelating/sequestering agent may also function as a threshold agent when included in an effective amount. The concentrate can include about 0.1 wt. % to about 70 wt. %, about 5 wt. % to about 60 wt. %, about 5 wt. % to about 50 wt. %, and about 10 wt. % to about 40 wt. % of a chelating/sequestering agent.

Exemplary aminocarboxylic acids include, for example, N-hydroxyethyliminodiacetic acid, nitrilotriacetic acid (NTA), ethylenediaminetetraacetic acid (EDTA), N-hydroxyethyl-ethylenediaminetriacetic acid (HEDTA), diethylenetriaminepentaacetic acid (DTPA), and the like.

Examples of condensed phosphates include sodium and potassium orthophosphate, sodium and potassium pyrophosphate, sodium tripolyphosphate, sodium hexametaphosphate, and the like. A condensed phosphate may also assist, to a limited extent, in solidification of the composition by fixing the free water present in the composition as water of hydration.

The composition may include a phosphonate such as 1-hydroxyethane-1,1-diphosphonic acid $CH_3C(OH)[PO(OH)_2]_2$ (HEDP); amino tri(methylenephosphonic acid) $N[CH_2PO(OH)_2]_3$; aminotri(methylenephosphonate), sodium salt

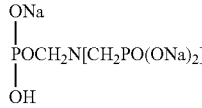

2-hydroxyethyliminobis(methylenephosphonic acid) $HOCH_2CH_2N[CH_2PO(OH)_2]_2$; diethylenetriaminepenta(methylenephosphonic acid) $(HO)_2POCH_2N[CH_2CH_2N[CH_2PO(OH)_2]_2]_2$; diethylenetriaminepenta(methylenephosphonate), sodium salt $C_9H_{(28-x)}N_3Na_xO_{15}P_5$ (x=7); hexamethylenediamine(tetramethylenephosphonate), potassium salt $C_{10}H_{(28-x)}N_2K_xO_{12}P_4$ (x=6); bis(hexamethylene) triamine(pentamethylenephosphonic acid) $(HO_2)POCH_2N[CH_2)_6N[CH_2PO(OH)_2]_2]_2$; and phosphorus acid $H_3PO_3$. Exemplary phosphonates are HEDP, ATMP and DTPMP. A neutralized or alkaline phosphonate, or a combination of the phosphonate with an alkali source prior to being added into the mixture such that there is little or no heat or gas generated by a neutralization reaction when the phosphonate is added is preferred. The phosphonate can comprise a potassium salt of an organo phosphonic acid (a potassium phosphonate). The potassium salt of the phosphonic acid material can be formed by neutralizing the phosphonic acid with an aqueous potassium hydroxide solution during the manufacture of the solid detergent. The phosphonic acid sequestering agent can be combined with a potassium hydroxide solution at appropriate proportions to provide a stoichiometric amount of potassium hydroxide to neutralize the phosphonic acid. A potassium hydroxide having a concentration of from about 1 to about 50 wt % can be used. The phosphonic acid can be dissolved or suspended in an aqueous medium and the potassium hydroxide can then be added to the phosphonic acid for neutralization purposes.

Water conditioning polymers can be used as a form of builder. Exemplary water conditioning polymers include polycarboxylates. Exemplary polycarboxylates that can be used as builders and/or water conditioning polymers include those having pendant carboxylate ($—CO_2^-$) groups and include, for example, polyacrylic acid, maleic/olefin copolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, hydrolyzed acrylonitrile-methacrylonitrile copolymers, and the like. For a further discussion of chelating agents/sequestrants, see Kirk-Othmer, Encyclopedia of Chemical Technology, Third Edition, volume 5, pages 339-366 and volume 23, pages 319-320, the disclosure of which is incorporated by reference herein. The concentrate can include the water conditioning polymer in an amount of between about 0.1 wt. % and about 5 wt. %, and between about 0.2 wt. % and about 2 wt. %.

Bleaching agents for use in a cleaning compositions for lightening or whitening a substrate, include bleaching compounds capable of liberating an active halogen species, such as $Cl_2$, $Br_2$, —OCL and/or —$OBr^-$, under conditions typically encountered during the cleansing process. Suitable bleaching agents for use in the present cleaning compositions include, for example, chlorine-containing compounds such as a chlorine, a hypochlorite, chloramine. Exemplary halogen-releasing compounds include the alkali metal dichloroisocyanurates, chlorinated trisodium phosphate, the alkali metal hypochlorites, monochloramine and dichloramine, and the like. Encapsulated chlorine sources may also be used to enhance the stability of the chlorine source in the composition (see, for example, U.S. Pat. Nos. 4,618,914 and 4,830,773, the disclosure of which is incorporated by reference herein). A bleaching agent may also be a peroxygen or active oxygen source such as hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine, and the like. The composition can include an effective amount of a bleaching agent. When the concentrate includes a bleaching agent, it can be included in an amount of about 0.1 wt. % to about 60 wt. %, about 1 wt. % to about 20 wt. %, about 3 wt. % to about 8 wt. %, and about 3 wt. % to about 6 wt. %.

The composition can include an effective amount of detergent fillers, which does not perform as a cleaning agent per se, but cooperates with the cleaning agent to enhance the overall cleaning capacity of the composition. Examples of detergent fillers suitable for use in the present cleaning compositions include sodium sulfate, sodium chloride, starch, sugars, $C_1$-$C_{10}$ alkylene glycols such as propylene glycol, and the like. When the concentrate includes a detergent filler, it can be included an amount of about 1 wt. % to about 20 wt. % and between about 3 wt. % to about 15 wt. %.

A defoaming agent for reducing the stability of foam may also be included in the composition to reduce foaming. When the concentrate includes a defoaming agent, the defoaming agent can be provided in an amount of between about 0.01 wt. % and about 3 wt. %.

Examples of defoaming agents that can be used in the composition includes ethylene oxide/propylene block copolymers such as those available under the name Pluranic N-3, silicone compounds such as silica dispersed in polydimethylsiloxane, polydimethylsiloxane, and functionalized polydimethylsiloxane such as those available under the name Abil B9952, fatty amides, hydrocarbon waxes, fatty acids, fatty esters, fatty alcohols, fatty acid soaps, ethoxylates, mineral oils, polyethylene glycol esters, alkyl phosphate esters such as monostearyl phosphate, and the like. A discussion of defoaming agents may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated by reference herein.

The composition can include an anti-redeposition agent for facilitating sustained suspension of soils in a cleaning solution and preventing the removed soils from being redeposited onto the substrate being cleaned. Examples of suitable anti-redeposition agents include fatty acid amides, fluorocarbon surfactants, complex phosphate esters, styrene maleic anhydride copolymers, and cellulosic derivatives such as hydroxyethyl cellulose, hydroxypropyl cellulose, and the like. When the concentrate includes an anti-redeposition agent, the anti-redeposition agent can be included in an amount of between about 0.5 wt. % to about 10 wt. %, and between about 1 wt. % and about 5 wt. %.

Stabilizing agents that can be used include primary aliphatic amines, betaines, borate, calcium ions, sodium citrate, citric acid, sodium formate, glycerine, maleonic acid, organic diacids, polyols, propylene glycol, and mixtures thereof. The concentrate need not include a stabilizing agent, but when the concentrate includes a stabilizing agent, it can be included in an amount that provides the desired level of stability of the concentrate. Exemplary ranges of the stabilizing agent include about 0 to about 20 wt. %, about 0.5 wt. % to about 15 wt. %, and about 2 wt. % to about 10 wt. %.

Dispersants that can be used in the composition include maleic acid/olefin copolymers, polyacrylic acid, and mixtures thereof. The concentrate need not include a dispersant, but when a dispersant is included it can be included in an amount that provides the desired dispersant properties. Exemplary ranges of the dispersant in the concentrate can be between about 0 and about 20 wt. %, between about 0.5 wt. % and about 15 wt. %, and between about 2 wt. % and about 9 wt. %.

Enzymes that can be included in the composition include those enzymes that aid in the removal of starch and/or protein stains. Exemplary types of enzymes include proteases, alpha-amylases, and mixtures thereof. Exemplary proteases that can be used include those derived from *Bacillus licheniformix, Bacillus lenus, Bacillus alcalophilus*, and *Bacillus amyloliquefacins*. Exemplary alpha-amylases include *Bacillus subtilis, Bacillus amyloliquefaceins* and *Bacillus licheniformis*. The concentrate need not include an enzyme. When the concentrate includes an enzyme, it can be included in an amount that provides the desired enzymatic activity when the warewashing composition is provided as a use composition. Exemplary ranges of the enzyme in the concentrate include between about 0 and about 15 wt. %, between about 0.5 wt. % and about 10 wt. %, and between about 1 wt. % and about 5 wt. %.

Silicates can be included in the warewashing composition to provide for metal protection. Silicates are additionally known to provide alkalinity and additionally function as anti-redeposition agents. Exemplary silicates include sodium silicate and potassium silicate. The warewashing composition can be provided without silicates, but when silicates are included, they can be included in amounts that provide for desired metal protection. The concentrate can include silicates in amounts of at least about 1 wt. %, at least about 5 wt. %, at least about 10 wt. %, and at least about 15 wt. %. In addition, in order to provide sufficient room for other components in the concentrate, the silicate component can be provided at a level of less than about 35 wt. %, less than about 25 wt. %, less than about 20 wt. %, and less than about 15 wt. %.

The concentrate can include water. In general, it is expected that water may be present as a processing aid and may be removed or become water of hydration. It is expected that water may be present in both the liquid concentrate and in the solid concentrate. In the case of the liquid concentrate, it is expected that water will be present in a range of between about 5 wt. % and about 60 wt. %, between about 10 wt. % and about 35 wt. %, and between about 15 wt. % and about 25 wt. %. In the case of a solid concentrate, it is expected that the water will be present in ranges of between about 0 wt. % and about 10 wt. %, about 0.1 wt. % and about 10 wt. %, about 1 wt. % and about 5 wt. %, and about 2 wt. % and about 3 wt. %. It should be additionally appreciated that the water may be provided as deionized water or as softened water.

Various dyes, odorants including perfumes, and other aesthetic enhancing agents can be included in the composition. Dyes may be included to alter the appearance of the composition, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keystone Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), and the like.

Fragrances or perfumes that may be included in the compositions include, for example, terpenoids such as citronellol, aldehydes such as amyl cinnamaldehyde, a jasmine such as C1S-jasmine or jasmal, vanillin, and the like.

The components used to form the concentrate can include an aqueous medium such as water as an aid in processing. It is expected that the aqueous medium will help provide the components with a desired viscosity for processing. In addition, it is expected that the aqueous medium may help in the solidification process when is desired to form the concentrate as a solid. When the concentrate is provided as a solid, it can be provided in the form of a block or pellet. It is expected that blocks will have a size of at least about 5 grams, and can include a size of greater than about 50 grams. It is expected that the concentrate will include water in an amount of between about 1 wt. % and about 50 wt. %, and between about 2 wt. % and about 40 wt. %.

When the components that are processed to form the concentrate are processed into a block, it is expected that the components can be processed by extrusion techniques or casting techniques. In general, when the components are processed by extrusion techniques, it is believed that the composition can include a relatively smaller amount of water as an aid for processing compared with the casting techniques. In general, when preparing the solid by extrusion, it is expected that the composition can contain between about 2 wt. % and about 10 wt. % water. When preparing the solid by casting, it is expected that the amount of water can be provided in an amount of between about 20 wt. % and about 40 wt. %.

Formulating the Warewashing Composition

The warewashing detergent composition can be formulated to handle the expected corrosion in a given environment. That is, the concentration of the corrosion inhibitors can be adjusted depending upon several factors at the situs of use including, for example, water hardness, food soil concentration, alkalinity, and builder concentration. It is expected that the concentration of each of these can have an effect on glass corrosion. In machine warewashing applications, a food soil concentration of about 25 grams per gallon or more is considered high, a concentration of about 15 to about 24 grams per gallon is considered medium, and a concentration of about 14 grams per gallon or less is considered low. Water hardness exhibiting 15 grains per gallon or more is considered high, about 6 to about 14 grains per gallon is considered medium, and about 5 grains per gallon or less is considered low. In a use composition, an alkalinity of about 300 ppm or higher is considered high, an alkalinity of about 200 ppm to about 300 ppm is considered medium, and an alkalinity of about 200 ppm or less is considered low. In a use composition, a builder concentration of about 300 ppm or more is considered high, a builder concentration of about 150 ppm to about 300 ppm is considered medium, and a builder concentration of 150 ppm or less is considered low.

Based upon the expected conditions of use, the warewashing detergent composition can be formulated to provide the desired level of corrosion and/or etching resistance. Based upon the knowledge of water hardness, food soil concentration, alkalinity, and builder concentration expected at the situs of use, the detergent composition can be formulated with a sufficient amount of corrosion inhibitor by reference to FIG. 1. In FIG. 1, the charted values represent the concentration of corrosion inhibitor provided in the use composition.

When formulating or manufacturing the detergent composition, the amount of corrosion inhibitor can be provided based upon the expected levels of water hardness, food soil concentration, alkalinity, and builder concentration at the situs of use. The amount of corrosion inhibitor in the use composition to provide the desired level of corrosion and/or etching resistance can be provided based upon the following formula:

$$\text{Corrosion inhibitor} > \text{use composition (ppm)} \frac{\begin{bmatrix}\text{alkalinity (ppm)} + \\ \text{builder (ppm)}\end{bmatrix}}{\begin{bmatrix}\text{hardness (grains/gallon)} + \\ \text{food soil (grams/gallon)}\end{bmatrix}} + \frac{\begin{bmatrix}\text{alkalinity (ppm)} + \\ \text{builder (ppm)} - 200\end{bmatrix}}{20} + 10$$

Based on the desired minimum concentration of the corrosion inhibitor in the use composition, the amount of the corrosion inhibitor in the concentrate can be calculated knowing the solids content of the use composition and the concentrate can be formulated to provide at least the desired level of corrosion protection.

Forming the Concentrate

The components can be mixed and extruded or cast to form a solid such as pellets or blocks. Heat can be applied from an external source to facilitate processing of the mixture.

A mixing system provides for continuous mixing of the ingredients at high shear to form a substantially homogeneous liquid or semi-solid mixture in which the ingredients are distributed throughout its mass. The mixing system includes means for mixing the ingredients to provide shear effective for maintaining the mixture at a flowable consistency, with a viscosity during processing of about 1,000-1,000,000 cP, preferably about 50,000-200,000 cP. The mixing system can be a continuous flow mixer or a single or twin screw extruder apparatus.

The mixture can be processed at a temperature to maintain the physical and chemical stability of the ingredients, such as at ambient temperatures of about 20-80° C., and about 25-55° C. Although limited external heat may be applied to the mixture, the temperature achieved by the mixture may become elevated during processing due to friction, variances in ambient conditions, and/or by an exothermic reaction between ingredients. Optionally, the temperature of the mixture may be increased, for example, at the inlets or outlets of the mixing system.

An ingredient may be in the form of a liquid or a solid such as a dry particulate, and may be added to the mixture separately or as part of a premix with another ingredient, as for example, the cleaning agent, the aqueous medium, and additional ingredients such as a second cleaning agent, a detergent adjuvant or other additive, a secondary hardening agent, and the like. One or more premixes may be added to the mixture.

The ingredients are mixed to form a substantially homogeneous consistency wherein the ingredients are distributed substantially evenly throughout the mass. The mixture can be discharged from the mixing system through a die or other shaping means. The profiled extrudate can be divided into useful sizes with a controlled mass. The extruded solid can be packaged in film. The temperature of the mixture when discharged from the mixing system can be sufficiently low to enable the mixture to be cast or extruded directly into a packaging system without first cooling the mixture. The time between extrusion discharge and packaging can be adjusted to allow the hardening of the detergent block for better handling during further processing and packaging. The mixture at the point of discharge can be about 20-90° C., and about 25-55° C. The composition can be allowed to harden to a solid form that may range from a low density, sponge-like, malleable, caulky consistency to a high density, fused solid, concrete-like block.

Optionally, heating and cooling devices may be mounted adjacent to mixing apparatus to apply or remove heat in order to obtain a desired temperature profile in the mixer. For example, an external source of heat may be applied to one or more barrel sections of the mixer, such as the ingredient inlet section, the final outlet section, and the like, to increase fluidity of the mixture during processing. Preferably, the temperature of the mixture during processing, including at the discharge port, is maintained preferably at about 20-90° C.

When processing of the ingredients is completed, the mixture may be discharged from the mixer through a discharge die. The composition eventually hardens due to the chemical reaction of the ingredients forming the E-form hydrate binder. The solidification process may last from a few minutes to about six hours, depending, for example, on the size of the cast or extruded composition, the ingredients of the composition, the temperature of the composition, and other like factors. Preferably, the cast or extruded composition "sets up" or begins to hardens to a solid form within about 1 minute to about 3 hours, preferably about 1 minute to about 2 hours, preferably about 1 minute to about 20 minutes.

The concentrate can be provided in the form of a liquid. Various liquid forms include gels and pastes. Of course, when the concentrate is provided in the form of a liquid, it is not necessary to harden the composition to form a solid. In fact, it is expected that the amount of water in the composition will be sufficient to preclude solidification. In addition, dispersants and other components can be incorporated into the concentrate in order to maintain a desired distribution of components.

The packaging receptacle or container may be rigid or flexible, and composed of any material suitable for containing the compositions produced according to the invention, as for example glass, metal, plastic film or sheet, cardboard, cardboard composites, paper, and the like. Advantageously, since the composition is processed at or near ambient temperatures, the temperature of the processed mixture is low enough so that the mixture may be cast or extruded directly into the container or other packaging system without structurally damaging the material. As a result, a wider variety of materials may be used to manufacture the container than those used for compositions that processed and dispensed under molten conditions. Preferred packaging used to contain the compositions is manufactured from a flexible, easy opening film material.

The packaging material can be provided as a water soluble packaging material such as a water soluble packaging film. Exemplary water soluble packaging films are disclosed in U.S. Pat. Nos. 6,503,879; 6,228,825; 6,303,553; 6,475,977; and 6,632,785, the disclosures of which are incorporated herein by reference. An exemplary water soluble polymer that can provide a packaging material that can be used to package the concentrate includes polyvinyl alcohol. The packaged concentrate can be provided as unit dose packages or multiple dose packages. In the case of unit dose packages, it is expected that a single packaged unit will be placed in a dishwashing machine, such as the detergent compartment of the dishwashing machine, and will be used up during a single wash cycle. In the case of a multiple dose package, it is expected that the unit will be placed in a hopper and a stream of water will degrade a surface of the concentrate to provide a liquid concentrate that will be introduced into the dishwashing machine.

Suitable water soluble polymers which may be used in the invention are described in Davidson and Sittig, *Water Soluble* Resins, Van Nostrand Reinhold Company, New York (1968), herein incorporated by reference. The water soluble polymer should have proper characteristics such as strength and pliability in order to permit machine handling. Preferred water soluble polymers include polyvinyl alcohol, cellulose ethers, polyethylene oxide, starch, polyvinylpyrrolidone, polyacrylamide, polyvinyl methyl ether-maleic anhydride, polymaleic anhydride, styrene maleic anhydride, hydroxyethylcellulose, methylcellulose, polyethylene glycols, carboxymethylcellulose, polyacrylic acid salts, alginates, acrylamide copolymers, guar gum, casein, ethylene-maleic anhydride resin series, polyethyleneimine, ethyl hydroxyethylcellulose, ethyl methylcellulose, hydroxyethyl methylcellulose. Lower molecular weight water soluble, polyvinyl alcohol film-forming polymers are generally, preferred. Polyvinyl alcohols that can be used include those having a weight average molecular weight of between about 1,000 and about 300,000, and between about 2,000 and about 150,000, and between about 3,000 and about 100,000.

The cleaning composition made according to the present invention is dispensed from a spray-type dispenser such as that disclosed in U.S. Pat. Nos. 4,826,661, 4,690,305, 4,687,121, 4,426,362 and in U.S. Pat. Nos. Re 32,763 and 32,818, the disclosures of which are incorporated by reference herein. Briefly, a spray-type dispenser functions by impinging a water spray upon an exposed surface of the solid composition to dissolve a portion of the composition, and then immediately directing the concentrate solution comprising the composition out of the dispenser to a storage reservoir or directly to a point of use. When used, the product can be removed from the package (e.g.) film and is inserted into the dispenser. The spray of water can be made by a nozzle in a shape that conforms to the solid detergent shape. The dispenser enclosure can also closely fit the detergent shape in a dispensing system that prevents the introduction and dispensing of an incorrect detergent.

While the invention is described in the context of a warewashing composition for washing articles in an automatic dishwashing machine, it should be understood that the warewashing composition can be used for washing non-ware items. That is, the warewashing composition can be referred to as a cleaning composition and can be used to clean various items and, in particular, items that may suffer from corrosion and/or etching. It should be understood that certain components that may be included in a warewashing composition because it is intended to be used in an automatic dishwashing machine can be excluded from a cleaning composition that is not intended to be used in an automatic dishwashing machine, and vice versa. For example, surfactants that have a tendency to create quite a bit of foaming may be used in a cleaning composition that is not intended to be used in an automatic dishwashing machine. Applications for a cleaning composition that includes a corrosion inhibitor that reduces corrosion of glass includes cleaning of hard surfaces. Exemplary hard surfaces include those that contain glass and/or ceramic. Exemplary surfaces include windows and mirrors. It should be understood that such a cleaning composition may find application in the vehicle washing industry because of the presence of glass on motor vehicles.

The warewashing composition can be provided in several forms including solids and liquids. When provided in the form of a solid, the warewashing composition can be provided in the form of powder, granules, pellets, tablets, blocks, cast solids, and extruded solids. By way of example, pellets can have sizes of between about 1 mm and about 10 mm diameter, tablets can have sizes of between about 1 mm and about 10 mm diameter, tablets can have sizes of between about 1 cm and about 10 cm diameter, and blocks can have sizes of at least about 10 cm diameter. When provided in the form of a liquid, the warewashing composition can be provided as a gel or a paste. Exemplary ranges for components of the warewashing composition when provided as a gel or a paste are shown in Table 1. Exemplary ranges for components of the warewashing composition when provided as a solid are shown in Table 2.

TABLE 1

Gel or Paste Warewashing Composition (wt. %)

| Component | First Exemplary Range | Second Exemplary Range | Third Exemplary Range |
|---|---|---|---|
| Water | 5-60 | 10-35 | 15-25 |
| Alkaline Source | 5-40 | 10-30 | 15-20 |
| Silicate | 5-35 | 10-25 | 15-20 |
| Builder | 1-30 | 3-20 | 6-15 |
| Stabilizer | 0-20 | 0.5-15 | 2-10 |
| Dispersant | 0-20 | 0.5-15 | 2-9 |
| Enzyme | 0-15 | 0.5-10 | 1-5 |
| Corrosion Inhibitor | 0.5-15 | 1-10 | 2-5 |
| Surfactant | 0.5-15 | 1-10 | 2-5 |
| Fragrance | 0-10 | 0.01-5 | 0.1-2 |
| Dye | 0-1 | 0.001-0.5 | 0.01-0.25 |

TABLE 2

Solid Warewashing Composition (wt. %)

| Component | First Exemplary Range | Second Exemplary Range | Third Exemplary Range |
|---|---|---|---|
| Water | 0-10 | 1-5 | 2-3 |
| Alkaline Source | 5-40 | 10-30 | 15-20 |
| Builder | 1-60 | 25-50 | 35-45 |
| Bleach | 1-55 | 15-45 | 25-35 |
| Silicate | 1-35 | 5-25 | 10-15 |
| Dispersant | 0-10 | 0.001-5 | 0.01-1 |
| Enzyme | 0-15 | 1-10 | 2-5 |
| Corrosion Inhibitor | 0.5-15 | 1-10 | 2-5 |
| Surfactant | 0.5-15 | 1-10 | 2-5 |
| Fragrance | 0-10 | 0.01-5 | 0.1-2 |
| Dye | 0-1 | 0.001-0.5 | 0.01-0.25 |

The various forms of the warewashing composition concentrate can be provided in a water soluble packaging film. That is, solids and liquids can be packaged in the water soluble films. Exemplary solids that can be packaged in a water soluble film include powders, pellets, tablets, and blocks. Exemplary liquids that can be packaged in the water soluble film include gels and pastes.

The above specification provides a basis for understanding the broad meets and bounds of the invention. The following examples and test data provide an understanding of certain specific embodiments of the invention. The examples are not meant to limit the scope of the invention that has been set forth in the foregoing description. Variations within the concepts of the invention are apparent to those skilled in the art.

Example 1

The following examples were conducted to compare the etching of glassware from Libbey glass based on several warewashing compositions. The glassware obtained was unused and fresh out of the box. One glass was used per test. The containers used to hold the sample were quartz plastic containers without paper liners in the lid.

The following procedure was followed.

1. Place gloves on before washing the glasses to prevent skin oils from contacting the glassware.
2. The glassware is scrubbed thoroughly with neutral pH liquid dish detergent (a pot and pan detergent available under the name "Express" from Ecolab Inc.) to remove dirt and oil and allowed to air dry.
3. Rinse all plastic containers with distilled water to remove any dust and allow to air dry.
4. Detergent solutions are prepared.
5. Place one glass in each plastic container and pour a solution into the plastic container ensuring that the glass is completely covered. Put the lid on the container and label with the solution name.
6. 20 mL of each solution is poured into 1 oz. plastic bottles and labeled.
7. Place the plastic containers in an agitated water bath. Control the temperature of the water bath to 160° F.
8. A water dispensing mechanism is set up to replenish the water bath throughout the duration of the test.
9. Collect 20 mL samples of the solution every 48 hours and place in the 1 oz. plastic bottles.
10. Upon completion of the test, samples were analyzed for calcium and silicon content.

To measure glass corrosion and demonstrate the protective effect of the corrosion inhibitor, the rates at which components were removed from the glassware exposed to the detergent solutions are measured. Over a period of days, the change in concentration of elemental silicon and elemental calcium in the detergent solution samples was analytically measured. Common soda-lime glass includes oxides of silicon, sodium, calcium, magnesium, and aluminum. Since it is well known that detergent builders can form complexes with calcium, the presence of calcium in the test solutions was measured to determine whether the detergent builders were accelerating the removal of calcium from the glass surface, thereby contributing to the corrosion process. The glass specimens were submerged in the detergents solutions at elevated temperatures. Polyethylene bottles were used to contain the solutions, so the only source of the elements of interest was the glass specimens.

Table 3 reports the inhibition effect of sodium aluminate and zinc chloride in a sodium carbonate-based detergent solution. The composition of Base Composition 1 is reported in Table 4.

TABLE 3

Effect of Zinc and Aluminum Inhibitors, Sodium Carbonate-Based Detergent Composition

| Detergent Solution | | | | | | | | | Silicon Concentration Exposure Time (Hrs) | |
|---|---|---|---|---|---|---|---|---|---|---|
| Product | Product Conc. | NaOH (ppm) | Ash (ppm) | Builder (ppm) | Zn (ppm) | Al (ppm) | Water | Temp. ° F. | 24 | 48 |
| Base Composition 1 | | 2.26 | 46.78 | 32.9 | 24 | | distilled | 160 | 2.14 | 3.91 |
| Base Composition 1 | | 2.26 | 46.78 | 32.9 | | 16.5 | distilled | 161 | 2.88 | 5.12 |
| Base Composition 1 | | 2.26 | 46.78 | 32.9 | 12 | 8.3 | distilled | 162 | 0.84 | 1.08 |
| Base Composition 1 | | 2.26 | 46.78 | 32.9 | 24 | 16.5 | distilled | 163 | <0.05 | 0.67 |

TABLE 4

Base Composition 1

| Component | % by wt. |
|---|---|
| Soft Water | 6.5 |
| alcohol ethoxylate | 2.5 |
| EO, PO block polymer | 1.4 |
| phosphate ester | 0.2 |
| Sodium aminotriemethylenephosphonate | 5.9 |
| Sodium Carbonate | 51 |
| Sodium tripolyphosphate | 30 |

The testing showed that the presences of both sodium aluminate and zinc chloride in the detergent solution reduced the rate of silica and calcium removed from the glass. The combination of sodium aluminate and zinc chloride reduced the corrosion rate more than an equal concentration of either one alone.

Example 2

The corrosion inhibition effect of sodium aluminate and zinc chloride in a caustic detergent solution is reported in Table 5. The composition of Base Composition 2 used to form the detergent solution is reported in Table 6.

TABLE 5

Protective Effect of Glass Corrosion Inhibitors in a Caustic Detergent Composition

| Product | | | | | test | Silicon concentration (ppm) Exposure Time (hrs) | | | | | Calcium concentration (ppm) Exposure Time (hrs) | | | | |
|---|---|---|---|---|---|---|---|---|---|---|---|---|---|---|---|
| Product | Conc. (ppm) | Zn (ppm) | Al (ppm) | Water | TEMP ° F. | 24 Hrs. | 48 Hrs. | 72 Hrs. | 96 Hrs. | 120 Hrs. | 24 Hrs. | 48 Hrs. | 72 Hrs. | 96 Hrs. | 120 Hrs. |
| Base Composition 2 | 1200 | 0 | 0 | distilled | 160 | 44 | 71 | 83 | 103 | 145 | 9 | 12 | 15 | | 27 |
| Base Composition 2 | 1200 | 12 | 8 | distilled | 160 | 2 | 4 | 7 | 10 | | 1 | 1 | 2 | 2 | |

TABLE 4-continued

Base Composition 1

| Component | % by wt. |
|---|---|
| Sodium Hydroxide | 2 |
| Nonionic surfactant | 0.5 |

Without the corrosion inhibitor present, the concentration of silica and calcium in solution increases over time as the materials are removed from the glass surface. With the corrosion inhibitor present, the concentration of silica and calcium still increases, but at a dramatically lower rate.

TABLE 6

Base Composition 2

| Component | % by wt. |
|---|---|
| Water | 17.000 |
| Nonionic surfactant | 1.000 |
| Polycarboxylic acid | 2.000 |
| Sodium hydroxide | 34.000 |
| Sodium Carbonate | 17.000 |
| Dye | 0.003 |
| Sodium tripolyphosphate | 29.00 |

Example 3

The effect of water hardness and caustic-based detergent composition on glass corrosion is reported in Table 7. The water hardness is reported in units of gpg (grains per gallon) wherein one grain is equivalent to 17.1 ppm of water hardness as expressed in calcium carbonate. The composition of Base Composition 3 is reported in Table 8.

TABLE 7

Effect of Water Hardness and Caustic-based Detergent Composition

| | Product conc. (ppm) | Zn (ppm) | Al (ppm) | Water Hardness (gpg) | test TEMP. ° F. | Silicon concentration (ppm) Exposure Time (hrs) 24 Hrs. | 48 Hrs. | 72 Hrs. | 96 Hrs. | 120 Hrs. |
|---|---|---|---|---|---|---|---|---|---|---|
| Base Composition 3 | 1200 | 0 | 0 | 17 | 160 | 12 | 34 | 47 | 81 | |
| Base Composition 3 | 1200 | 0 | 0 | 0 | 160 | 44 | 71 | 83 | 103 | 145 |

TABLE 8

Base Composition 3

| Component | % by wt. |
|---|---|
| Sodium carbonate | 41.100 |
| Sodium sulfate | 14.385 |
| Nonionic surfactant | 0.215 |
| Alcohol ethoxylate surfactant | 2.500 |
| Sodium polyacrylate | 0.300 |
| Sodium silicate $2.00SiO_2/Na_2O$ | 6.000 |
| Sodium tripoly phosphate | 30.500 |
| Sodium perborate monohydrate | 5.000 |

Example 4

The effect of food soil and caustic-based detergent composition on glass corrosion is reported in Table 9. The food soil provided was beef stew soil at 2 wt. % in the test solution. The composition of Base Composition 4 is reported in Table 10.

TABLE 9

Effect of Food Soil, Caustic-based Detergent

| | Product conc. (ppm) | Inhibitor (ppm) | Zn (ppm) | Al (ppm) | Water Hardness (gpg) | test TEMP. ° F. | Silicon concentration (ppm) Exposure Time (hrs) 48 Hrs. | 96 Hrs. | Calcium concentration (ppm) Exposure Time (hrs) 48 Hrs. | 96 Hrs. |
|---|---|---|---|---|---|---|---|---|---|---|
| Base Composition 4 with food soil | 1200 | 0 | 0 | 0 | city | 160 | 23 | 47 | 7 | 8 |
| Base Composition 4 without food soil | 1200 | 0 | 0 | 0 | city | 160 | 40 | 94 | 9 | 19 |

TABLE 10

Base Composition 4

| Component | % by wt. |
|---|---|
| Water | 24.000 |
| Nonionic surfactant | 1.000 |
| Polycarboxylic acid | 2.000 |

TABLE 10-continued

Base Composition 4

| Component | % by wt. |
|---|---|
| Sodium hydroxide | 43.000 |
| Sodium Chloride | 10.000 |
| Sodium Nitrilotriacetate | 20.00 |

Example 5

The corrosion inhibition effect of corrosion inhibitors in sodium carbonate-based detergent composition is reported in Table 11.

TABLE 11

Effect of Glass Corrosion Inhibitors, Sodium Carbonate-based Detergent Composition

| Product | Product Conc. (ppm) | Zn (ppm) | Al (ppm) | Water | test TEMP ° F. | Silicon concentration (ppm) Exposure Time (hrs) 24 Hrs. | 48 Hrs. | 72 Hrs. | 96 Hrs. | 120 Hrs. | Calcium concentration (ppm) Exposure Time (hrs) 24 Hrs. | 48 Hrs. | 72 Hrs. | 96 Hrs. | 120 Hrs. |
|---|---|---|---|---|---|---|---|---|---|---|---|---|---|---|---|
| Base Composition 3 | 1200 | | | distilled | 160 | 27 | 39 | 51 | | 71 | 6 | 8 | 10 | | 13 |
| Base Composition 3 | 1200 | 12 | 8 | distilled | 160 | 0 | 2 | 3 | 2 | | 0 | 0 | 1 | 1 | |

Example 6

The effect of food soil and sodium carbonate-based detergent composition on glass corrosion is reported in Table 12. The food soil is an oatmeal soil at 2 wt. % in the test solution.

TABLE 12

Effect of Food Soil, Sodium Carbonate-based Detergent Composition

| | Product conc. (ppm) | Zn (ppm) | Al (ppm) | Water type | test TEMP. ° F. | Silicon concentration (ppm) Exposure Time (hrs) 48 Hrs. | 96 Hrs. | Calcium concentration (ppm) Exposure Time (hrs) 48 Hrs. | 96 Hrs. |
|---|---|---|---|---|---|---|---|---|---|
| Base Composition 3 without food soil | 1200 | 1 | 1 | soft | 160 | 7 | 16 | 4 | 6 |
| Base Composition 3 with food soil | 1200 | 1 | 1 | soft | 160 | 4 | 10 | 0 | 0 |

Example 7

The effect of water hardness and sodium carbonate-based detergent composition is reported in Table 13.

TABLE 13

Effect of Water Hardness, Sodium Carbonate-based Detergent Composition

| | Product conc. (ppm) | Zn (ppm) | Al (ppm) | Water type | test TEMP. ° F. | Silicon concentration (ppm) Exposure Time (hrs) 48 Hrs. | 96 Hrs. | Calcium concentration (ppm) Exposure Time (hrs) 48 Hrs. | 96 Hrs. |
|---|---|---|---|---|---|---|---|---|---|
| Base Composition 3 | 4300 | 41 | 28 | soft | 160 | 8 | 13 | 3 | 5 |
| Base Composition 3 | 4300 | 41 | 28 | hard | 160 | 0 | 0 | 0 | 0 |
| Base Composition 3 | 4300 | 41 | 28 | city | 160 | 2 | 3 | 1 | 3 |

Example 8

The corrosion inhibiting effect of corrosion inhibitors and non-phosphate, NTA-based detergent composition is reported in Table 14.

TABLE 14

| Effect of Glass Corrosion Inhibitors, Non-Phosphate, NTA-Based Detergent Composition | | | | | | | |
|---|---|---|---|---|---|---|---|
| | Product conc. (ppm) | Zn (ppm) | Al (ppm) | Water type | test TEMP. ° F. | Silicon concentration (ppm) Exposure Time (hrs) 96 Hrs. | Calcium concentration (ppm) Exposure Time (hrs) 96 Hrs. |
| Base Composition 4 | 1200 | | | distilled | 160 | 92 | 17 |
| Base Composition 4 | 1200 | 12 | 8 | distilled | 160 | 22 | 4 |

Example 9

Figure 2:
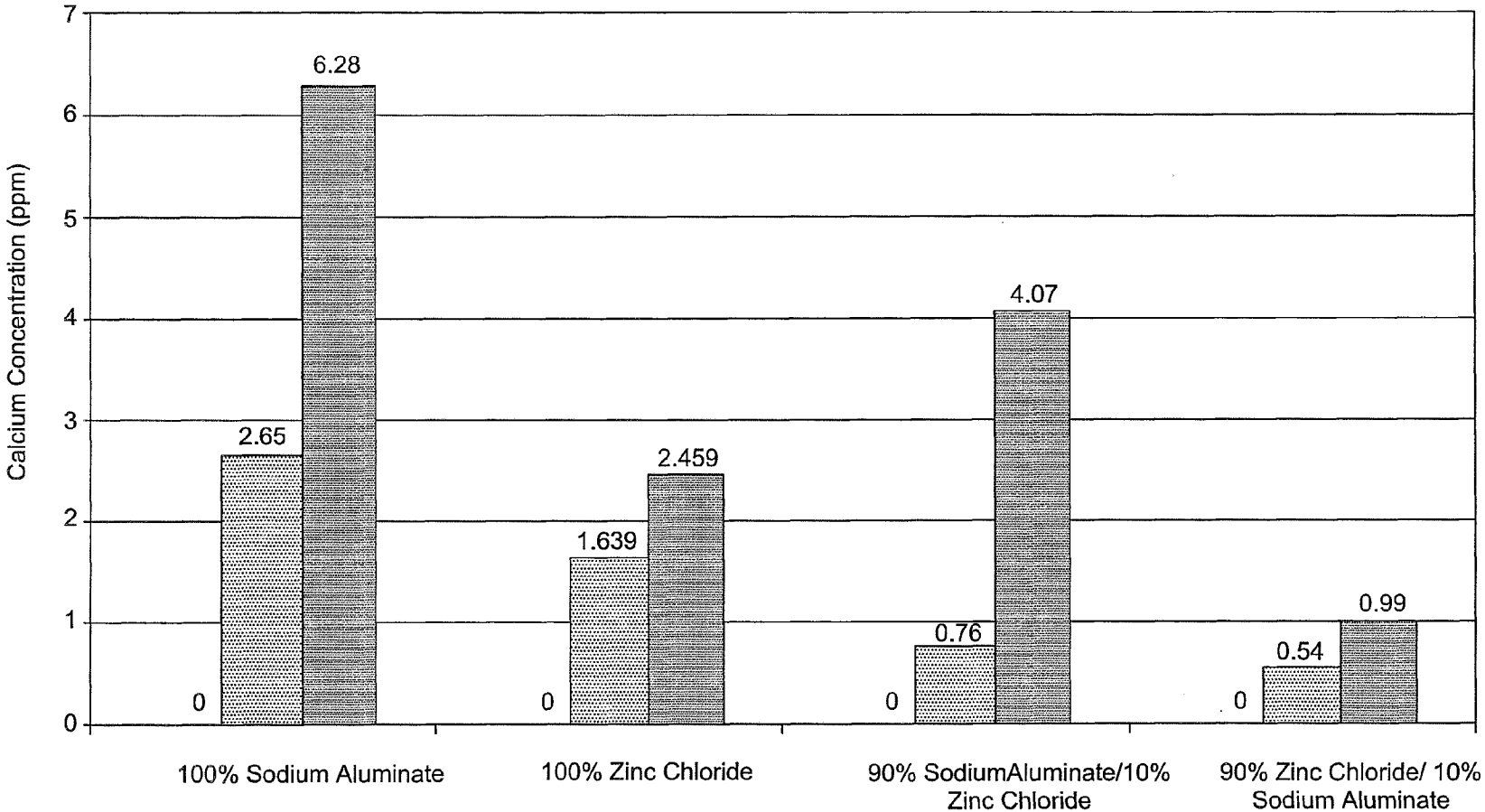
FIG. 2 is a graph showing silicon concentration in four warewashing compositions at 48 hours and 96 hours according to Example 9
Figure 3:
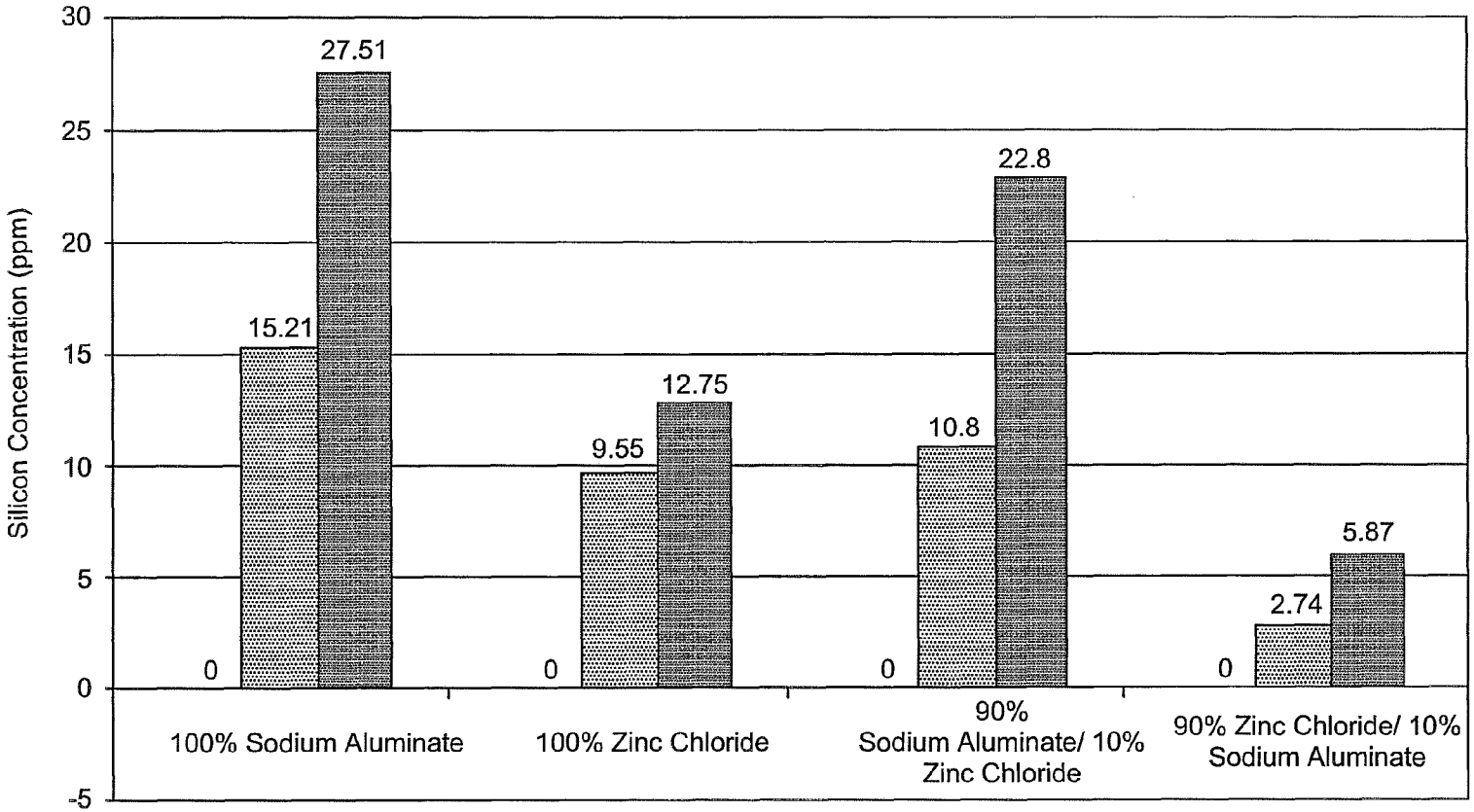
FIG. 3 is a graph showing calcium concentration in four warewashing compositions at 48 hours and 96 hours according to Example 9

The effect of the amount of corrosion inhibitor in the concentrate is reported in Table 15. The data from Table 15 is graphically represented in FIGS. 2 and 3.

TABLE 15

| Effect of Corrosion Inhibitor | | | | | | | | | |
|---|---|---|---|---|---|---|---|---|---|
| | Product conc. | Zn | Al | Water | test TEMP. | Silicon concentration (ppm) Exposure Time (hrs) | | Calcium concentration (ppm) Exposure Time (hrs) | |
| | (ppm) | (ppm) | (ppm) | type | ° F. | 48 Hrs. | 96 Hrs. | 48 Hrs. | 96 Hrs. |
| Base Composition 1 | 1200 | 23 | | soft | 160 | 10 | 13 | 1.6 | 2.5 |
| Base Composition 1 | 1200 | | 16 | soft | 160 | 15 | 28 | 3 | 6 |
| Base Composition 1 | 1200 | 2.3 | 14.00 | soft | 160 | 11 | 26 | 1 | 4 |
| Base Composition 1 | 1200 | 21.00 | 1.60 | soft | 160 | 3 | 6 | 0.5 | 1 |

Example 10

An exemplary warewashing composition is provided in Table 16.

TABLE 16

| Warewashing Composition | |
|---|---|
| Components | Wt. % |
| Part A | |
| DI Water | 21.23 |
| Hydroxyethylidene diphosphonic acid | 15.50 |
| Part B | |
| Potassium hydroxide (45%) | 10.37 |
| Polyacrylic acid | 7.00 |
| Potassium silicate | 20.50 |
| nonionic surfactant | 2.00 |
| Part C | |
| potassium carbonate | 5.4 |
| zinc chloride | 2.00 |
| Sodium aluminate | 2.00 |
| Sodium silicate | 7.00 |
| Boric acid | 3.00 |

TABLE 16-continued

| Warewashing Composition | |
|---|---|
| Components | Wt. % |
| Part D | |
| Enzyme | 3.00 |
| Fragrance | 1.00 |
| | 100.00 |

The composition was prepared by forming Part A by combining the hydroxyethylidene diphosphonic acid and deionized water with mixing, mixing the components of Part B, and adding Part B to Part A with mixing. The components of Part C were mixed and then Part C was combined with Parts A and B with mixing. The composition was allowed to cool to 80° F., and the components of Part D were added with mixing. The resulting composition could be characterized as a paste. It is expected that the composition could provide desired corrosion resistance in soft water.

Example 11

Quantitative Measure of Glass Etch Inhibition by Inductively Coupled Plasma Spectroscopy (ICP)

A 0.46% use composition of a dish gel from Example 10 was prepared in soft water and added to a 1-quart high density polyethylene jar containing a 10 ounce drinking glasses called Collins Glass Straight Sided Shell. The jar was placed in an oscillating shaker batch set at 160° F. for 96 hours. Samples of the detergent solution were taken at t=0 and t=96 hours and tested by ICP for silicon levels before and after the test. The level of silicon was compared to a commercially available detergent powder (Cascade Complete from Proctor and Gamble) at the suggested use composition concentration of 0.23% and several other commercially available gel products at 0.43% detergent. The commercially available gel products tested include Cascade Pure Rinse gel from Proctor and Gamble, Palmolive gel from Colgate Palmolive, Electrasol gel from Reckitt Benckiser, and Sunlight gel from Lever Brothers. The level of silicon was used as a measure of the amount of glass etching occurring during exposure to the detergent solutions. At the conclusion of the 96 hour test period, a silicon concentration 71 ppm was detected in the Cascade Complete solution, and silicon levels from 58 to 93 ppm were detected in the solutions of the commercial gel products. There was no increase in silicon from initial solution level at t=0 in the solution prepared from the dish gel of example 10 indicating no corrosion occurred.

Example 12

Qualitative Measure of Glass Etch Inhibition by Visual Inspection of Glassware

Under the same experimental conditions as example 11 above, the glasses in each test solution were removed after 96 hours, rinsed in soft water and allowed to dry. The glasses were visually inspected. The glasses exposed to the Cascade Complete solution revealed initial stages of etching as rainbow colored striations. The glasses tested with the use composition obtained from the gel of example 10 showed no signs of etching under the same test conditions.

Example 13

Preparation of an Automatic Dishwashing Detergent with Glass Etch Protection and Quantitative Measure of Glass Etch Inhibition by ICP The components of Table 17 were mixed together to form a base warewashing composition.

TABLE 17

| Base Warewashing Composition | |
|---|---|
| Components | Wt. % |
| Sodium percarbonate | 32.00 |
| Pentasodium diethylenetriamine pentaacetate | 4.90 |
| Sodium tripolyphosphate | 33.94 |
| Stearic monoethanolamide | 0.21 |
| Polyether siloxane | 0.58 |
| Maleic/olefin copolymer, sodium salt | 0.30 |
| Enzyme | 2.80 |
| Sodium silicate | 12.00 |
| Sodium sulfate | 4.10 |
| Polycarboxylate, sodium salt | 0.30 |
| Alcohol alkoxylate | 2.40 |

TABLE 17-continued

| Base Warewashing Composition | |
|---|---|
| Components | Wt. % |
| EO/PO copolymer | 1.30 |
| Fragrance | 1.00 |
| sub-total | 96.00 |

The base warewashing composition of Table 17 was split into separate smaller batches and varying amounts of zinc chloride and sodium aluminate were added to each to provide a total composition of 100 wt. %. Table 18 shows the various compositions of zinc chloride and sodium aluminate added to the base warewashing composition of Table 17.

TABLE 18

| Composition Added to Base Warewashing Composition | | | | | |
|---|---|---|---|---|---|
| | Composition (grams) | | | | |
| Components | A | B | C | D | E |
| Base warewashing composition | 96.00 | 96.00 | 96.00 | 96.00 | 96.00 |
| ZnCl2 | 0 | 1.0 | 2.0 | 3.0 | 4.0 |
| NaAlO2 | 4.0 | 3.0 | 2.0 | 1.0 | 0 |
| Total | 100.00 | 100.00 | 100.00 | 100.00 | 100.00 |

Figure 4:
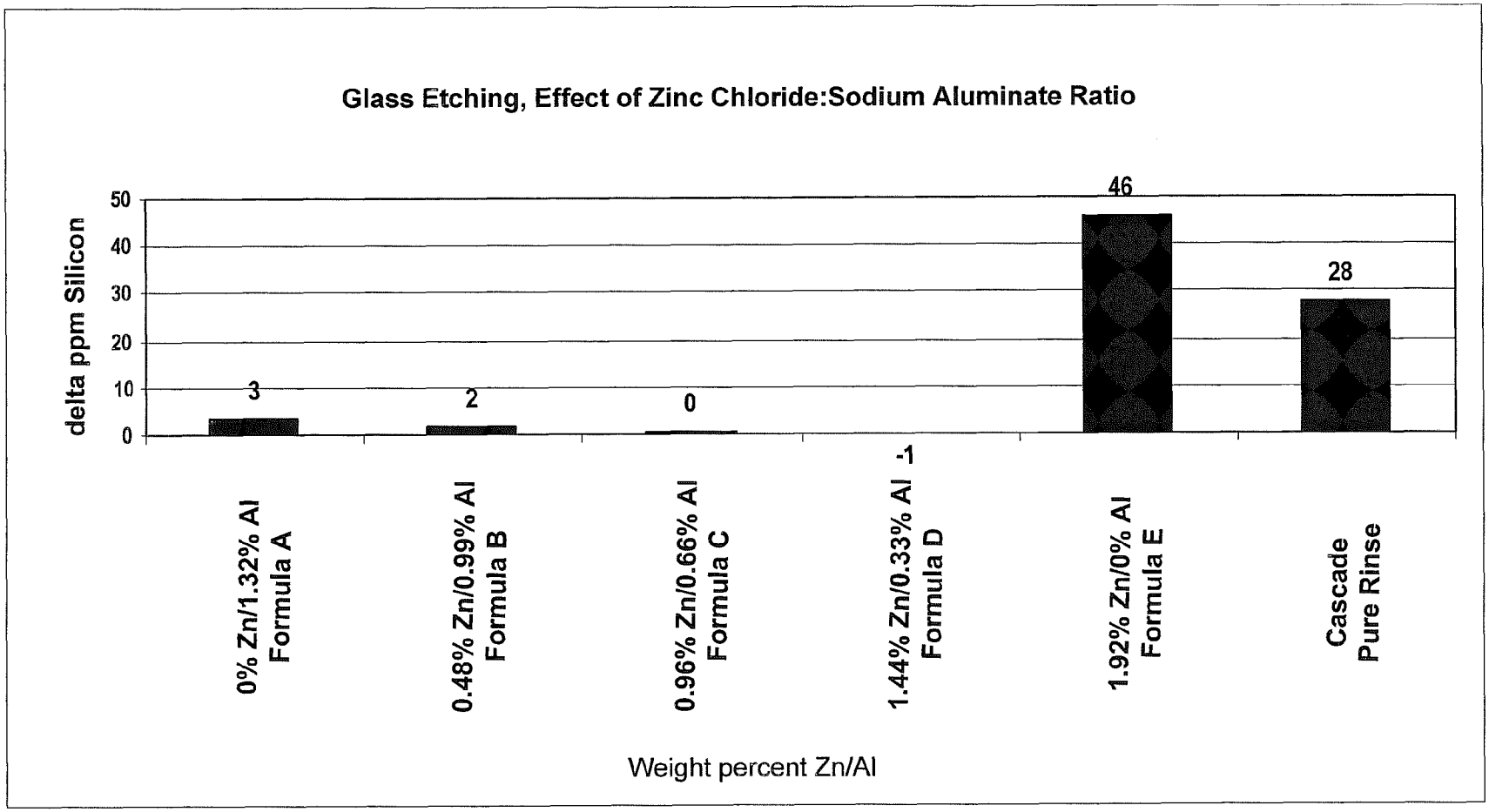
FIG. 4 is a graph showing silicon concentration in warewashing compositions at 96 hours according to Example 13.

A 0.23% use composition of each dish detergent was prepared in 7 grain hardness water and added to a 1-quart high density polyethylene jar containing a 10-ounce drinking glasses called Collins Glass Straight Sided Shell. The jar was placed in an oscillating shaker batch set at 160° F. for 96 hours. Samples of the detergent solution were taken at t=0 and t=96 hours and tested by ICP for silicon levels before and after the test. The level of silicon was compared to a commercially available detergent powder (Cascade Complete from Proctor and Gamble) at the suggested use composition concentration of 0.23%. The level of silicon was used as a measure of the amount of glass etching occurring during exposure to the detergent solutions. At the conclusion of the 96 hour test period, a 3:1 weight percent ratio of zinc chloride to sodium aluminate provided the best etch protection. Complete removal of sodium aluminate from the detergent (4% Zn/0% Al) resulted in a large increase in glass etching, whereas the detergent sample without zinc chloride (0% Zn/4% Al) still provided some etch protection. The results of this example are reported in FIG. 4.

Example 14

Qualitative Measure of Film Formation on Glass Vials

Figure 5:
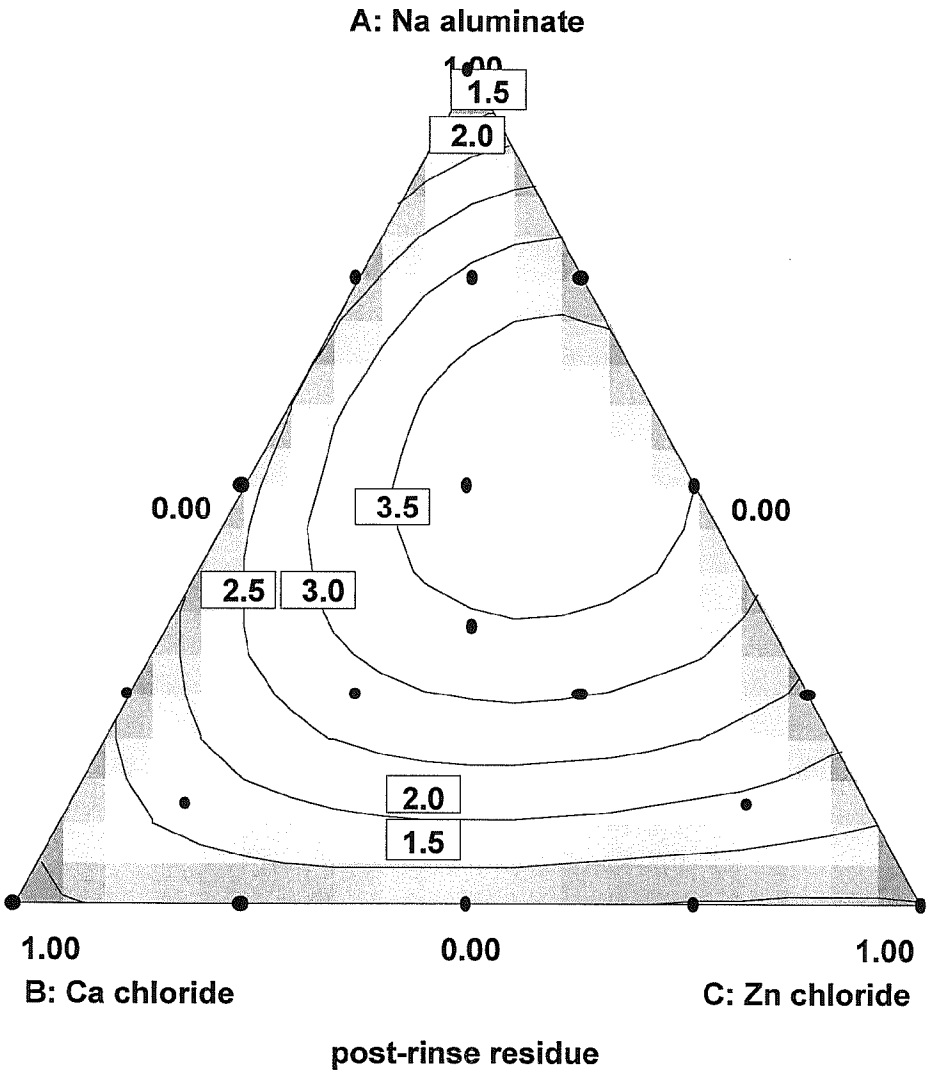
FIG. 5 is a graph showing a ternary plot of concentration of sodium aluminate, zinc chloride, and calcium carbonate according to Example 14.

A ternary mixture experiment was conducted on 40 mL glass vials containing 100 ppm solution of varying ratios of zinc chloride, sodium aluminate and calcium chloride. pH was held at about 10 with the addition of sodium carbonate, if needed to maintain pH. The glass vials were filled with test solution and heated in an oven for about 108 hours at 160° F. The vials were then emptied and rinsed thoroughly with water. The post rinse residue left on the glass was determined qualitatively based on the following scale: 1=no visible residue, 2=light residue, 3=medium residue, 4=heavy residue. A ratio of 53 parts sodium aluminate: 16 parts calcium chloride: 31 parts zinc chloride is near the area of maximum post rinse residue which relates to sealing between levels 3 and 4. At a ratio of 1:1 zinc chloride:sodium aluminate, the solution enters the region of greatest post rinse residue when the chelation capacity of the detergent is exceeded. This corresponds to a level of 3 to 4 on the above scale. The results of this example are reported in the ternary diagram of FIG. 5.

Example 16

Figure 6:
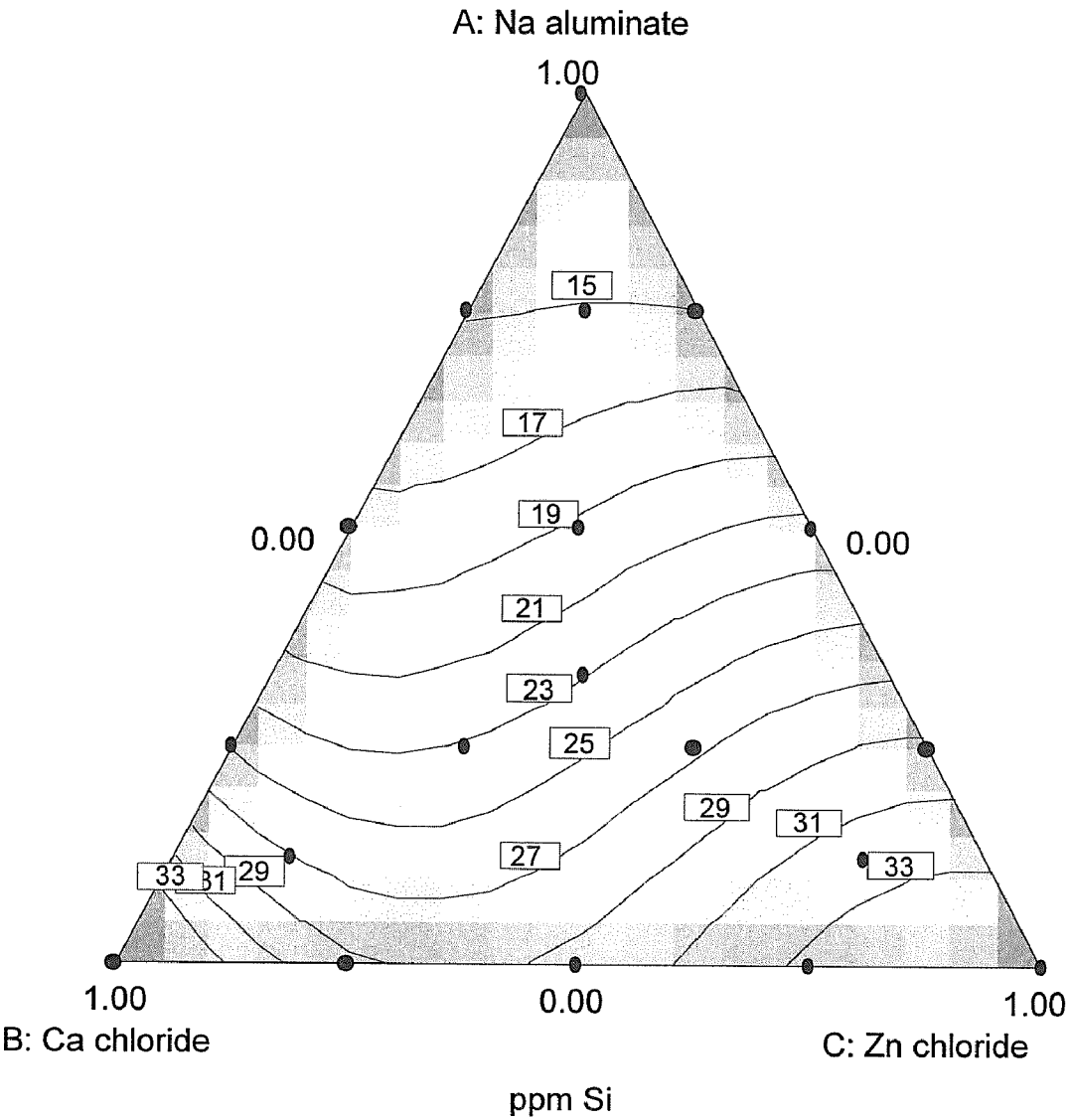
FIG. 6 is a graph showing a ternary plot of concentration of sodium aluminate, zinc chloride, and calcium carbonate according to Example 15.

Quantitative Determination of Glass Etching Based on Varying Ratios of Sodium Aluminate, Zinc Chloride and Calcium Chloride A ternary mixture experiment was conducted to determine the effect of varying levels of sodium aluminate, zinc chloride and calcium chloride of glass vials as measured by the increase in silicon in test solutions after 108 hours at 160° F. Test solutions were adjusted to pH 10 with soda ash. Total amounts of zinc chloride, sodium aluminate, and calcium chloride provided 100 ppm in each vial. A plot of the data shows that the degree of etching increases as the level of sodium aluminate decreases. The results of this example are shown in the ternary diagram of FIG. 6. It is believed that corrosion resistance may be due to deposition of a sparingly soluble aluminate salt onto the glass surface. Accordingly, it is believed that the corrosion inhibitor for glass protection can be selected to provide minimal deposition of visible film in the presence of hard water containing free calcium ion.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A warewashing detergent composition comprising:

(a) a cleaning agent comprising a detersive amount of a surfactant;

(b) an alkaline source comprised of at least 17 weight percent carbonate or bicarbonate or hydroxide in an amount effective to provide a use composition having a pH of at least about 8 and obtained by diluting the warewashing detergent composition with water; and (c) a corrosion inhibitor in an amount sufficient for reducing corrosion of glass, the corrosion inhibitor comprising:

(i) a source of aluminum ion;

(ii) a source of zinc ion; and (iii) wherein the source of aluminum ion and the source of zinc ion are present in amounts sufficient to provide a use composition having a weight ratio of zinc ion to aluminum ion of at least about 2:1 up to about 15:1;

(d) encapsulated chlorine bleaching agent; and (e) less than 10 weight percent water wherein the detergent is formed into a block.

2. A warewashing detergent composition according to claim 1, wherein the detergent composition comprises between about 0.5 wt. % and about 20 wt. % of the cleaning agent.

3. A warewashing detergent composition according to claim 1, wherein the source of aluminum ion and the source of zinc ion are present in amounts sufficient to provide a use composition having a weight ratio of zinc ion to aluminum ion of between about 15:1 and about 3:1.

4. A warewashing detergent composition according to claim 1, wherein the source of aluminum ion and the source of zinc ion are present in amounts sufficient to provide a use composition having a weight ratio of zinc ion to aluminum ion of between about 15:1 and about 4:1.

5. A warewashing detergent composition according to claim 1, wherein the detergent composition comprises between about 0.5 wt. % and about 25 wt. % of the corrosion inhibitor.

6. A warewashing detergent composition according to claim 1, wherein the cleaning agent comprises at least one of an anionic surfactant, a nonionic surfactant, a cationic surfactant, and a zwitterionic surfactant.

7. A warewashing detergent composition according to claim 1, wherein the alkaline source comprises at least one of a metal carbonate, an alkali metal hydroxide, and a mixture thereof.

8. A warewashing detergent composition according to claim 1, wherein the alkaline source comprises at least one of sodium carbonate, potassium carbonate, sodium bicarbonate, potassium bicarbonate, sodium sesquicarbonate, potassium sesquicarbonate, and mixtures thereof.

9. A warewashing detergent composition according to claim 1, wherein the alkaline source comprises at least one of sodium hydroxide, potassium hydroxide, and mixtures thereof.

10. A warewashing detergent composition according to claim 1, the source of aluminum ion comprises at least one of sodium aluminate, aluminum bromide, aluminum chlorate, aluminum chloride, aluminum iodide, aluminum nitrate, aluminum sulfate, aluminum acetate, aluminum formate, aluminum tartrate, aluminum lactate, aluminum oleate, aluminum bromate, aluminum borate, aluminum potassium sulfate, aluminum zinc sulfate, aluminum phosphate, aluminum oxide, aluminum silicate, and mixtures thereof.

11. A warewashing detergent composition according to claim 1, wherein the source of aluminum ion comprises a component characterized by the United States Food and Drug Administration as a direct or indirect food additive.

12. A warewashing detergent composition according to claim 1, wherein the source of aluminum ion comprises particles having an average particle size of less than about 500 nanometers.

13. A warewashing detergent composition according to claim 1, wherein the source of zinc ion comprises at least one of zinc chloride, zinc sulfate, zinc nitrate, zinc iodide, zinc thiocyanate, zinc fluorosilicate, zinc dichromate, zinc chlorate, sodium zincate, zinc gluconate, zinc acetate, zinc benzoate, zinc citrate, zinc lactate, zinc formate, zinc bromate, zinc bromide, zinc fluoride, zinc fluosilicate, zinc salicylate, zinc oxide, zinc aluminate, zinc silicate, and mixtures thereof.

14. A warewashing detergent composition according to claim 1, wherein the source of zinc ion comprises a component characterized by the United States Food and Drug Administration as a direct or indirect food additive.

15. A warewashing detergent composition according to claim 1, wherein the source of zinc ion comprises particles having an average particle size of less than about 500 nanometers.

16. A method for manufacturing the warewashing detergent composition of claim 1, the method comprising:

(A) providing a composition comprising:

(a) the cleaning agent;

(b) the alkaline source;

(c) the corrosion inhibitor;

(d) the encapsulated chlorine bleach; and (e) less than 10 weight percent water; and (B) forming the composition into a block.

17. A method according to claim 16, wherein the warewashing detergent concentrate comprises between about 0.01 wt. % and about 20 wt. % of the cleaning agent.

* * * * *